US008136931B2

(12) United States Patent
Miyazawa

(10) Patent No.: US 8,136,931 B2
(45) Date of Patent: Mar. 20, 2012

(54) INK-JET RECORDING DEVICE AND INK SUPPLY UNIT SUITABLE FOR IT

(75) Inventor: Hisashi Miyazawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 1031 days.

(21) Appl. No.: 12/037,618

(22) Filed: Feb. 26, 2008

(65) Prior Publication Data

US 2008/0151021 A1 Jun. 26, 2008

Related U.S. Application Data

(60) Division of application No. 10/819,756, filed on Apr. 6, 2004, now Pat. No. 7,350,907, which is a division of application No. 09/525,477, filed on Mar. 15, 2000, now Pat. No. 7,090,341, which is a continuation of application No. PCT/JP99/03839, filed on Jul. 15, 1999.

(30) Foreign Application Priority Data

Jul. 15, 1998 (JP) ..... P. 10-200377
Oct. 6, 1998 (JP) ..... P. 10-284104

(51) Int. Cl.
*B41J 2/175* (2006.01)

(52) U.S. Cl. ..... 347/86; 347/85; 347/84

(58) Field of Classification Search ..... 347/86, 347/84, 85
See application file for complete search history.

(56) References Cited

U.S. PATENT DOCUMENTS

| | | | |
|---|---|---|---|
| 2,526,019 | A | 10/1950 | Fowler |
| 2,646,063 | A | 7/1953 | Hayes |
| 3,073,339 | A | 1/1963 | Stelzer |
| 3,176,712 | A | 4/1965 | Ramsden |
| 3,270,771 | A | 9/1966 | Morgan et al. |
| 3,354,902 | A | 11/1967 | Obermaier |
| 3,465,786 | A | 9/1969 | Spisak |
| 3,508,576 | A | 4/1970 | Gross |
| 3,779,274 | A | 12/1973 | Kelly |
| 3,941,149 | A | 3/1976 | Mittleman |
| 4,152,710 | A | 5/1979 | Matsuba et al. |
| 4,183,031 | A | 1/1980 | Kyser et al. |
| 4,419,677 | A | 12/1983 | Kasugayama et al. |
| 4,514,742 | A | 4/1985 | Suga et al. |
| 4,520,369 | A | 5/1985 | Shackleton |
| 4,555,719 | A | 11/1985 | Arway et al. |
| 4,628,333 | A | 12/1986 | Terasawa |

(Continued)

FOREIGN PATENT DOCUMENTS

CN 1114530 7/2003

(Continued)

OTHER PUBLICATIONS

Derwent Abstracts, AN 93-015343, JP 04 345298, Dec. 1, 1992.

(Continued)

*Primary Examiner* — Laura Martin
(74) *Attorney, Agent, or Firm* — Stroock & Stroock & Lavan LLP

(57) ABSTRACT

Ink maintained at a negative pressure state is supplied to an ink-jet recording head via an ink supply mechanism constructed as a differential pressure valve having a coil spring and a movable membrane normally contacted elastically with a valve seat by the coil spring.

3 Claims, 19 Drawing Sheets

U.S. PATENT DOCUMENTS

| | | | |
|---|---|---|---|
| 4,677,447 | A | 6/1987 | Nielsen |
| 4,700,202 | A | 10/1987 | Kuranishi et al. |
| 4,869,282 | A | 9/1989 | Sittler et al. |
| 4,893,138 | A | 1/1990 | Terasawa et al. |
| 4,920,362 | A | 4/1990 | Cowger |
| 4,931,814 | A | 6/1990 | Yoshimura |
| 4,971,527 | A | 11/1990 | Dick |
| 5,025,271 | A | 6/1991 | Baker et al. |
| 5,039,997 | A | 8/1991 | Pullen et al. |
| 5,040,002 | A | 8/1991 | Pollacek et al. |
| 5,136,305 | A | 8/1992 | Ims |
| 5,136,309 | A | 8/1992 | Iida et al. |
| 5,138,344 | A | 8/1992 | Ujita |
| 5,280,300 | A | 1/1994 | Fong et al. |
| 5,305,795 | A | 4/1994 | Forberg |
| 5,343,226 | A | 8/1994 | Niedermeyer et al. |
| 5,367,328 | A | 11/1994 | Erickson |
| 5,388,615 | A | 2/1995 | Edlund et al. |
| 5,426,459 | A | 6/1995 | Kaplinsky |
| 5,453,772 | A | 9/1995 | Aono et al. |
| 5,477,963 | A | 12/1995 | Mochizuki et al. |
| 5,500,663 | A | 3/1996 | Ujita et al. |
| 5,539,437 | A | 7/1996 | Penwell |
| 5,583,549 | A | 12/1996 | Ujita et al. |
| 5,646,664 | A | 7/1997 | Pawlowski, Jr. |
| 5,657,058 | A | 8/1997 | Mochizuki et al. |
| 5,671,000 | A | 9/1997 | Hirabayashi et al. |
| 5,691,753 | A | 11/1997 | Hilton |
| 5,721,576 | A | 2/1998 | Barinaga |
| 5,732,751 | A | 3/1998 | Schmidt et al. |
| 5,736,992 | A | 4/1998 | Pawlowski, Jr. |
| 5,737,001 | A | 4/1998 | Taylor |
| 5,751,319 | A | 5/1998 | Robertson et al. |
| 5,777,646 | A | 7/1998 | Barinaga et al. |
| 5,777,647 | A | 7/1998 | Pawlowski, Jr. et al. |
| 5,796,419 | A | 8/1998 | Clark et al. |
| 5,801,737 | A | 9/1998 | Sato et al. |
| 5,805,188 | A | 9/1998 | Nakajima et al. |
| 5,847,735 | A | 12/1998 | Betschon et al. |
| 5,900,985 | A | 5/1999 | Ho et al. |
| 5,963,237 | A | 10/1999 | Ikkatai et al. |
| 5,969,737 | A | 10/1999 | Koyama et al. |
| 6,000,788 | A | 12/1999 | Iida |
| 6,010,211 | A | 1/2000 | Betschon |
| 6,010,212 | A | 1/2000 | Yamashita et al. |
| 6,022,102 | A | 2/2000 | Ikkatai et al. |
| 6,078,808 | A | 6/2000 | Fukutomi et al. |
| 6,079,808 | A | 6/2000 | Yamaguchi |
| 6,109,742 | A | 8/2000 | Higuma et al. |
| 6,130,696 | A | 10/2000 | Mashita et al. |
| 6,174,053 | B1 | 1/2001 | Higuma et al. |
| 6,193,364 | B1 | 2/2001 | Iida |
| 6,224,200 | B1 | 5/2001 | Higuma et al. |
| 6,238,042 | B1 | 5/2001 | Kobayashi et al. |
| 6,299,296 | B2 | 10/2001 | Gasvoda |
| 6,302,531 | B1 | 10/2001 | Usui et al. |
| 6,325,498 | B1 | 12/2001 | Higuma et al. |
| 6,332,481 | B1 | 12/2001 | Shinada et al. |
| 6,383,436 | B1 | 5/2002 | Nishimuro et al. |
| 6,390,611 | B1 | 5/2002 | Kobayashi et al. |
| 6,394,590 | B1 | 5/2002 | Koitabashi et al. |
| 6,416,152 | B1 | 7/2002 | Matsuzaki et al. |
| 6,422,691 | B2 | 7/2002 | Kobayashi et al. |
| 6,460,984 | B1 | 10/2002 | Matsumoto et al. |
| 6,550,901 | B2 | 4/2003 | Iida |
| 6,585,358 | B2 | 7/2003 | Usui et al. |
| 6,648,459 | B2 | 11/2003 | Usui et al. |
| 6,653,251 | B2 | 11/2003 | Sugimoto et al. |
| 6,666,551 | B2 | 12/2003 | Kobayashi et al. |
| 6,905,199 | B2 | 6/2005 | Miyazawa et al. |
| 6,945,641 | B2 | 9/2005 | Sakai et al. |
| 7,090,341 | B1 | 8/2006 | Miyazawa |
| 2002/0089083 | A1 | 7/2002 | Nishimuro et al. |
| 2002/0109760 | A1 | 8/2002 | Miyazawa et al. |
| 2002/0135646 | A1 | 9/2002 | Usui |
| 2002/0154200 | A1 | 10/2002 | Miyazawa et al. |
| 2002/0158948 | A1 | 10/2002 | Miyazawa et al. |
| 2002/0171721 | A1 | 11/2002 | Ota et al. |
| 2002/0171722 | A1 | 11/2002 | Hara et al. |
| 2002/0171723 | A1 | 11/2002 | Ota et al. |
| 2002/0180849 | A1 | 12/2002 | Sakai et al. |
| 2003/0007043 | A1 | 1/2003 | Ota et al. |
| 2003/0058312 | A1 | 3/2003 | Iida |
| 2003/0058313 | A1 | 3/2003 | Iida |
| 2003/0085970 | A1 | 5/2003 | Sakai et al. |
| 2003/0103119 | A1 | 6/2003 | Sakai et al. |
| 2003/0107627 | A1 | 6/2003 | Seino et al. |
| 2003/0107629 | A1 | 6/2003 | Kobayashi et al. |
| 2003/0128261 | A1 | 7/2003 | Usui et al. |
| 2003/0146959 | A1 | 8/2003 | Iida |
| 2004/0051766 | A1 | 3/2004 | Miyazawa et al. |
| 2004/0056936 | A1 | 3/2004 | Usui et al. |
| 2004/0085415 | A1 | 5/2004 | Kobayashi et al. |
| 2004/0160481 | A1 | 8/2004 | Miyazawa et al. |
| 2004/0239736 | A1 | 12/2004 | Miyazawa et al. |
| 2005/0030357 | A1 | 2/2005 | Sakai et al. |
| 2005/0057626 | A1 | 3/2005 | Usui et al. |
| 2006/0098062 | A1 | 5/2006 | Miyazawa |

FOREIGN PATENT DOCUMENTS

| | | | | |
|---|---|---|---|---|
| DE | 1009870 | | 6/1957 | |
| DE | 1 152 583 | | 9/1958 | |
| DE | 1852284 | | 11/1961 | |
| DE | 1550194 | | 8/1969 | |
| DE | 2230642 | | 12/1972 | |
| DE | 3 202 796 | A1 | 8/1983 | |
| DE | 34 46 182 | A1 | 7/1985 | |
| DE | 195 45 775 | A1 | 6/1997 | |
| EP | 0 112 701 | A2 | 7/1984 | |
| EP | 0 116 466 | A2 | 8/1984 | |
| EP | 0 238 829 | A2 | 9/1987 | |
| EP | 0 336 307 | A2 | 10/1989 | |
| EP | 0 339 770 | A2 | 11/1989 | |
| EP | 0 412 643 | A1 | 2/1991 | |
| EP | 0 424 133 | A2 | 4/1991 | |
| EP | 0 509 686 | A2 | 10/1992 | |
| EP | 0 529 880 | B1 | 3/1993 | |
| EP | 0 562 717 | A1 | 9/1993 | |
| EP | 0 589 540 | A1 | 3/1994 | |
| EP | 0 631 874 | A2 | 1/1995 | |
| EP | 0 709 207 | | 5/1996 | |
| EP | 709207 | A2 * | 5/1996 | ..... 2/175 |
| EP | 0 714 778 | | 6/1996 | |
| EP | 0 733 481 | A2 | 9/1996 | |
| EP | 0 742 102 | | 11/1996 | |
| EP | 0 760 288 | | 3/1997 | |
| EP | 0 794 059 | | 9/1997 | |
| EP | 0 803 365 | A2 | 10/1997 | |
| EP | 0 827 836 | A1 | 3/1998 | |
| EP | 879702 | | 11/1998 | |
| EP | 0 903 236 | A2 | 3/1999 | |
| EP | 919384 | | 6/1999 | |
| EP | 0 956 958 | A2 | 11/1999 | |
| EP | 1 016 533 | A1 | 7/2000 | |
| EP | 1 125 747 | A2 | 8/2001 | |
| EP | 1 199 178 | A1 | 4/2002 | |
| EP | 1 258 358 | A1 | 11/2002 | |
| EP | 1 270 235 | A1 | 1/2003 | |
| FR | 1 145 605 | | 10/1957 | |
| FR | 1 268 227 | | 6/1961 | |
| FR | 2 391 405 | A1 | 12/1978 | |
| GB | 751289 | | 6/1956 | |
| GB | 2 147 975 | | 5/1985 | |
| GB | 2 323 332 | A | 9/1998 | |
| JP | 55-146766 | | 11/1980 | |
| JP | 56-13183 | | 2/1981 | |
| JP | 57-006777 | | 1/1982 | |
| JP | 57-197176 | A | 12/1982 | |
| JP | 58-036457 | A | 3/1983 | |
| JP | 59-176545 | | 10/1984 | |
| JP | 62-231759 | | 10/1987 | |
| JP | 63-031934 | U | 3/1988 | |
| JP | 2-72271 | | 3/1990 | |
| JP | 02-198862 | | 8/1990 | |
| JP | 02-214666 | A | 8/1990 | |
| JP | 04-073158 | | 3/1992 | |
| JP | 04-43785 | | 7/1992 | |

| | | | |
|---|---|---|---|
| JP | 5-50609 | | 3/1993 |
| JP | 05-096744 | A | 4/1993 |
| JP | 05-131642 | A | 5/1993 |
| JP | 5-162324 | A | 6/1993 |
| JP | 5-201018 | | 8/1993 |
| JP | 5-229137 | | 9/1993 |
| JP | 06-246925 | A | 9/1994 |
| JP | 06-286154 | | 10/1994 |
| JP | 07-032604 | A | 2/1995 |
| JP | 07-195706 | A | 8/1995 |
| JP | 8-174860 | | 7/1996 |
| JP | 09-011497 | A | 1/1997 |
| JP | 09-234881 | A | 9/1997 |
| JP | 9-290514 | | 11/1997 |
| JP | 09-290514 | A | 11/1997 |
| JP | 10-006521 | A | 1/1998 |
| JP | 10-044468 | A | 2/1998 |
| JP | 10-58697 | A | 3/1998 |
| JP | 10-071726 | A | 3/1998 |
| JP | 10-86402 | | 4/1998 |
| JP | 10-109426 | A | 4/1998 |
| JP | 10-119313 | A | 5/1998 |
| JP | 10-166613 | A | 6/1998 |
| JP | 10-244685 | | 9/1998 |
| JP | 10-315504 | | 12/1998 |
| JP | 11-058772 | | 3/1999 |
| JP | 11-0091122 | | 4/1999 |
| JP | 11-170558 | | 6/1999 |
| JP | 11-179932 | | 7/1999 |
| JP | 11-227220 | A | 8/1999 |
| JP | 00/03877 | A1 | 1/2000 |
| JP | 01-78988 | A1 | 10/2001 |
| JP | 2001-270129 | | 10/2001 |
| JP | 2002-103642 | | 4/2002 |
| WO | 92/12371 | | 7/1992 |
| WO | 96/14913 | | 5/1996 |

OTHER PUBLICATIONS

Patent Abstracts of Japan, vol. 012, No. 098 (M-680), Mar. 31, 1998, JP 62 231759, Oct. 12, 1987.

Search Report from European Pat. Appln. 03 012 124.8 (Aug. 18, 2003).

Office Action in Japanese Patent Appln. 2003-19011 (Jun. 12, 2006).

European Search Report dated Sep. 14, 2009 issued in European Pat. App. No. 09165877.3.

* cited by examiner

INK-JET RECORDING DEVICE AND INK SUPPLY UNIT SUITABLE FOR IT

CROSS-REFERENCE TO RELATED APPLICATIONS

This application is a division of application Ser. No. 10/819,756, filed on Apr. 6, 2004, now U.S. Pat. No. 7,350,907, which is a division of application Ser. No. 09/525,477, filed on Mar. 15, 2000, now U.S. Pat. No. 7,090,341, which is a continuation of application No. PCT/JP99/03839, filed on Jul. 15, 1999.

TECHNICAL FIELD

The present invention relates to an ink-jet recording device composed of a carriage reciprocated in the direction of the width of a recording medium, an ink-jet recording head provided to the carriage and ink supply means mounted on the carriage for supplying ink to the recording head, more detailedly relates to technique for supplying ink while maintaining negative pressure applied to the recording head.

BACKGROUND ART

An ink-jet recording device used for printing a large number of pages is arranged, as disclosed in Japanese published examined patent application No. Hei 4-43785 for example, such that an ink tank, e.g. a cassette, is installed in the body, and connected to an ink supply unit mounted on a carriage via an ink supply tube to supply ink to be consumed for printing to a recording head via the ink supply unit.

This arrangement makes it possible to significantly eliminate change of ink pressure associated with the extension or the bending of a tube during the movement of the carriage, thereby maintaining print.

In order to enhance color print quality, a recording device is available, which uses plural kinds of ink, i.e. ink of different optical densities, for the same type color. In such recording device, the number of ink tubes is increased as the kinds of ink are increased. Since each ink tube must be guided to follow the movement of the carriage, a structure for wiring each tube becomes complicated or restricted. Further, the elasticity and rigidity of the tube influences the movement of the carriage, hindering high-speed printing.

To solve such a problem, as disclosed in Japanese published unexamined patent application No. Hei10-244685, a recording device has been proposed, which includes an ink supply unit, mounted on a carriage, for supplying ink to an ink-jet recording head, an ink cartridge installed on the body side, and an ink supplementing unit which is connected by a conduit and detachably engaged with the ink supply unit.

With this arrangement, the carriage is moved during printing in a state that the ink supply unit is detached from the conduit such as a tube, and the ink supply unit is connected to the conduit only when the ink supply unit should be supplemented by ink. Therefore, the tube forming the conduit is not required to follow the movement of the carriage, and wiring can be simplified. The carriage can be moved at high speed because the tube is not extended or is not contracted following the movement of the carriage, and thus the high speed printing can be realized.

However, as the supply of ink from the ink cartridge installed on the body side to the ink supply unit depends upon slight negative pressure caused by expansion force of an elastic member preliminarily installed in the ink supply unit, the recording device suffers from a problem that the negative pressure decreases to reduce the filled quantity of ink and to consume increased time period for ink filling as air is accumulated in the ink supply unit in association with a large number of times the ink filling is repeated.

To solve this problem, as disclosed in Japanese published unexamined patent application Hei8-174860, a recording device has been proposed, in which a differential pressure valve mechanism is disposed between the ink storage chamber side of the ink supply unit and the recording head, the mechanism having a membrane opened or closed depending upon the differential pressure of ink.

This arrangement makes it possible to supply ink to the recording head while maintaining the negative pressure, but still suffers from a problem that as the membrane also fluctuates as ink fluctuates due to the movement of the carriage, the ink to be supplied to the recording head is difficult to finely maintain the negative pressure therein.

In addition, as the membrane is disposed to extend horizontally, increased area of the membrane, thus increased installation space therefor is required to open or close valve means with a slight difference of the negative pressure to be maintained to the recording head. Consequently, the carriage of the recording device using plural kinds of ink for printing is large in size.

DISCLOSURE OF THE INVENTION

An ink-jet recording device according to the present invention includes a carriage reciprocated in the direction of the width of a recording medium, an ink-jet recording head provided to the carriage and ink supply means, mounted on the carriage, for supplying ink to the recording head. The ink supply means is constructed as a differential pressure valve having a coil spring and a movable membrane normally contacted elastically with a valve seat by the coil spring. The coil spring maintains pressure of ink supplied to the ink-jet recording head at a negative pressure state.

An ink supply unit according to the present invention is arranged such that a differential pressure valve is accommodated in a container. The differential pressure valve has a coil spring and a movable membrane normally contacted elastically with a valve seat by the coil spring. The container is provided with an ink storage chamber communicating with an ink supply port connected to an ink-jet recording head. The ink supply unit supplies ink of a negative pressure state to the ink-jet recording head.

In this arrangement, since differential pressure on a pressure receiving face is adjusted by the coil spring, the fluctuation of ink caused by the movement of a carriage is received by the coil spring, thereby maintaining negative pressure finely and suitably.

Therefore, an object of the present invention is to provide an ink-jet recording device and an ink supply unit suitable therefor, which can finely maintain negative pressure with high precision, and supply ink stably to a recording head.

BEST MODE FOR EMBODYING THE INVENTION

The present invention will be described in detail with reference to the illustrated embodiments.

Figure 1:
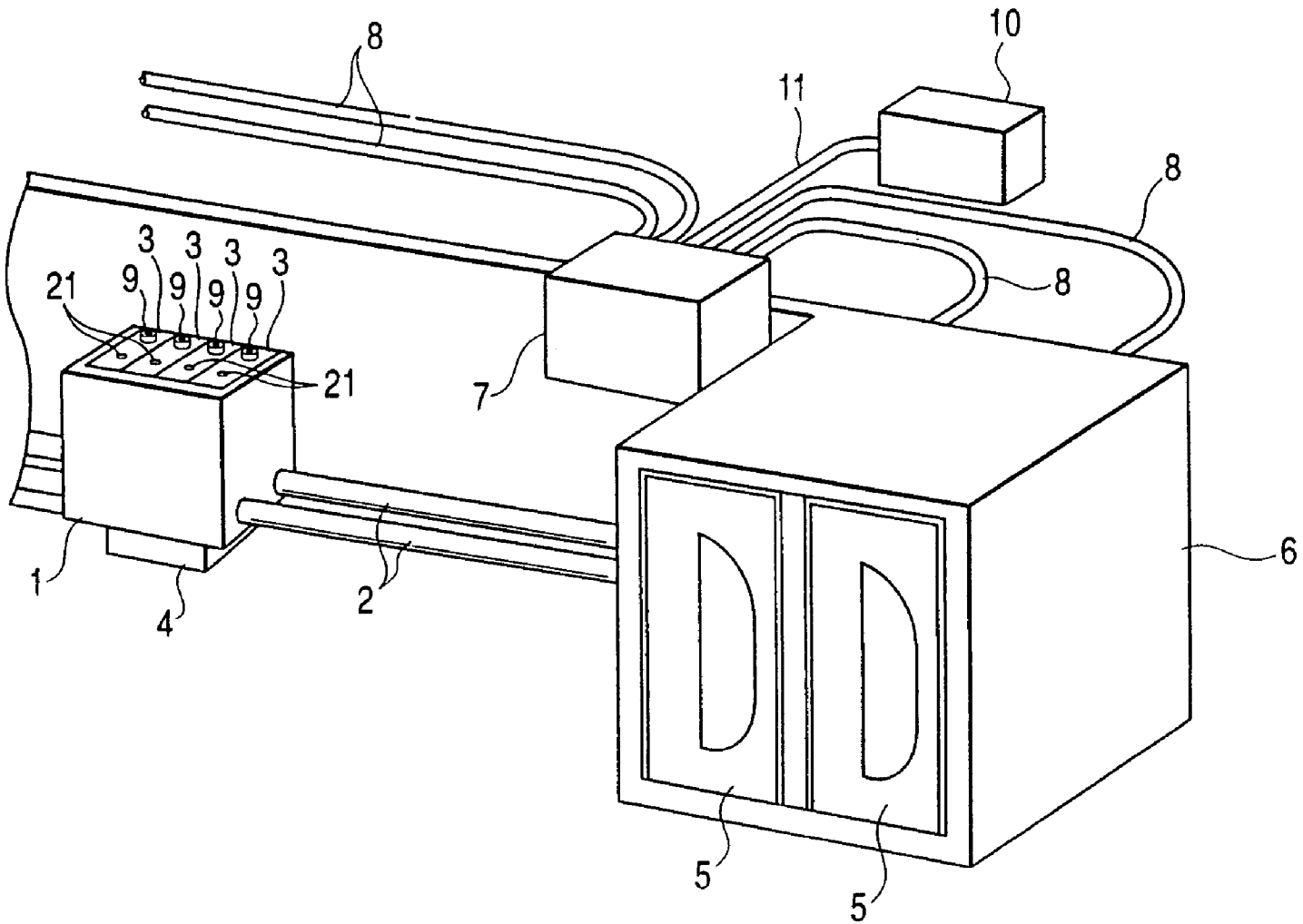
FIG. 1 shows an embodiment of an ink-jet recording device according to the present invention with the outline of its ink supply mechanism.

FIG. 1 shows an embodiment of the present invention. A carriage 1 is guided by a guide member 2, and can be reciprocated by driving means not shown. A plurality of ink supply units 3 (four ink supply units in this embodiment), each forming a feature of the present invention, are mounted on the upper part of the carriage 1, and a recording head 4 is provided on the lower surface of the carriage 1. A cartridge holder 6 for accommodating an ink cartridge 5 therein is disposed on each of the sides of an area where the carriage 1 is moved (only one side is shown in FIG. 1). An ink supplementing unit 7 is disposed above an non-printing area in the area where the carriage 1 is moved.

The ink supplementing unit 7 is connected to the ink cartridges 5 via tubes 8, and designed to connect to ink inlets 9 of the ink supply units 3 to inject ink up to a required level when the carriage 1 is moved to an ink supplementing area. A reference number 10 denotes a pump unit, i.e. an ink injecting pressure source, connected to the ink supplementing unit 7 via a tube 11.

Figure 2:
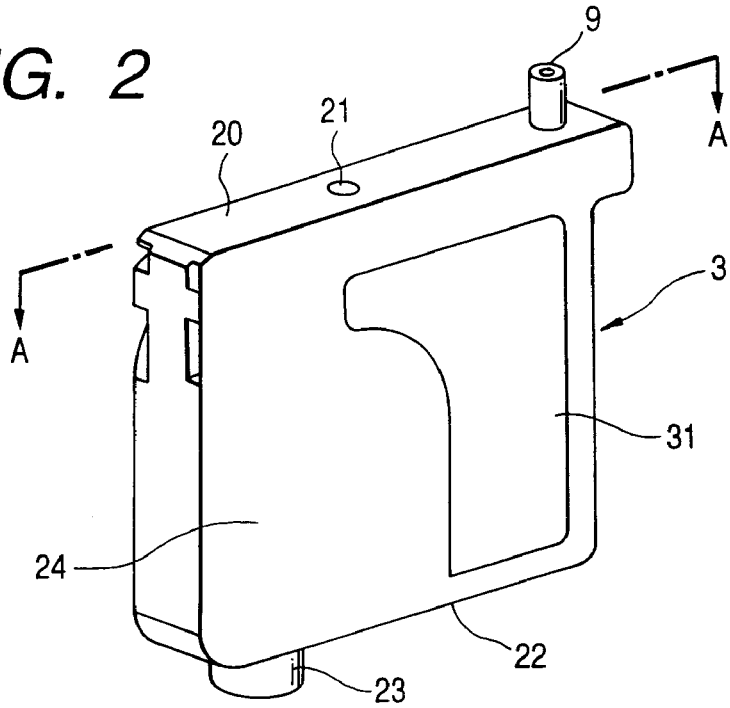
FIG. 2 is a perspective view showing an embodiment of an ink supply unit used for the device.

FIG. 2 shows an embodiment of the ink supply unit 3. The ink supply unit 3 is in the form of a flat container, which is formed on its upper surface 21 with the ink inlet 9 communicating with an ink storage chamber, and an air open port 21. An ink supply port 23 connected to the recording head 4 is formed in a lower area, on the lower surface 22 in this embodiment. A window is formed in an area, facing the ink storage chamber 36, of the side 24 of the container, and is sealed by a film 31. The film 31 is deformable with pressure of ink, and made of a laminated film in which a metallic layer having extremely low vapor permeability and extremely low gas permeability is laminated on a high polymer film, a high polymer film having extremely low vapor permeability and extremely low gas permeability, or the like.

Figure 3A:
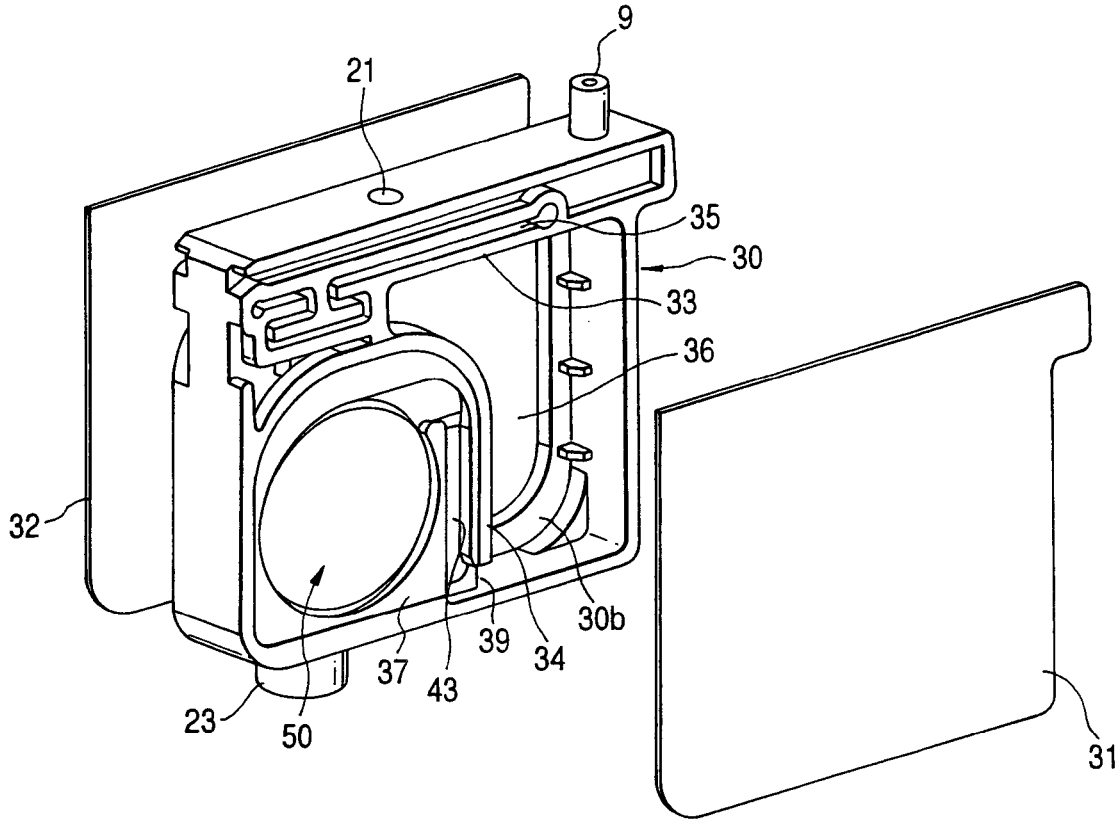
FIGS. 3 (*a*) and 3 (*b*) respectively show a state in which films for sealing the surface and the backface are detached and a state in which the films for sealing are omitted, of the one embodiment of the ink-supply unit.
Figure 3B:
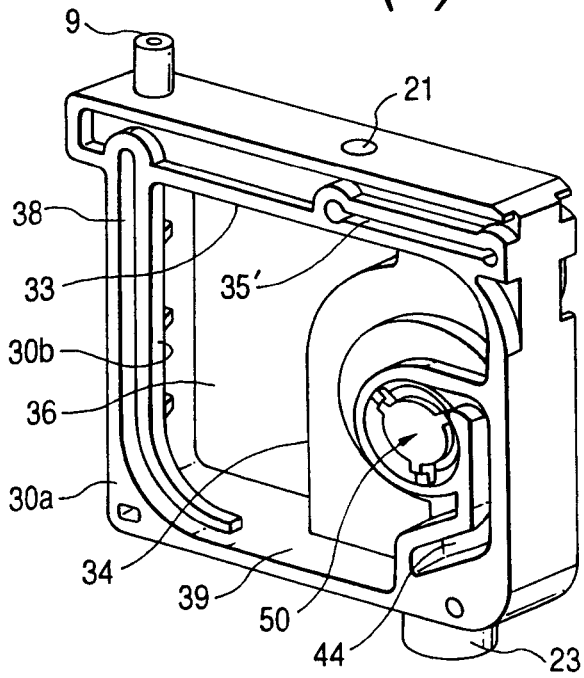

Referring to FIG. 3, the detailed structure of the ink supply unit 3 will be further described. The container forming the ink supply unit 3 roughly has a frame structure obtained by molding plastic material, etc., and opened sides of a casing 30 are respectively sealed by films 31 and 32, each made of a laminated film in which a metallic layer having extremely low vapor permeability and extremely low gas permeability is laminated on a high polymer film, a high polymer film having extremely low vapor permeability and extremely low gas permeability, or the like.

Figure 4:
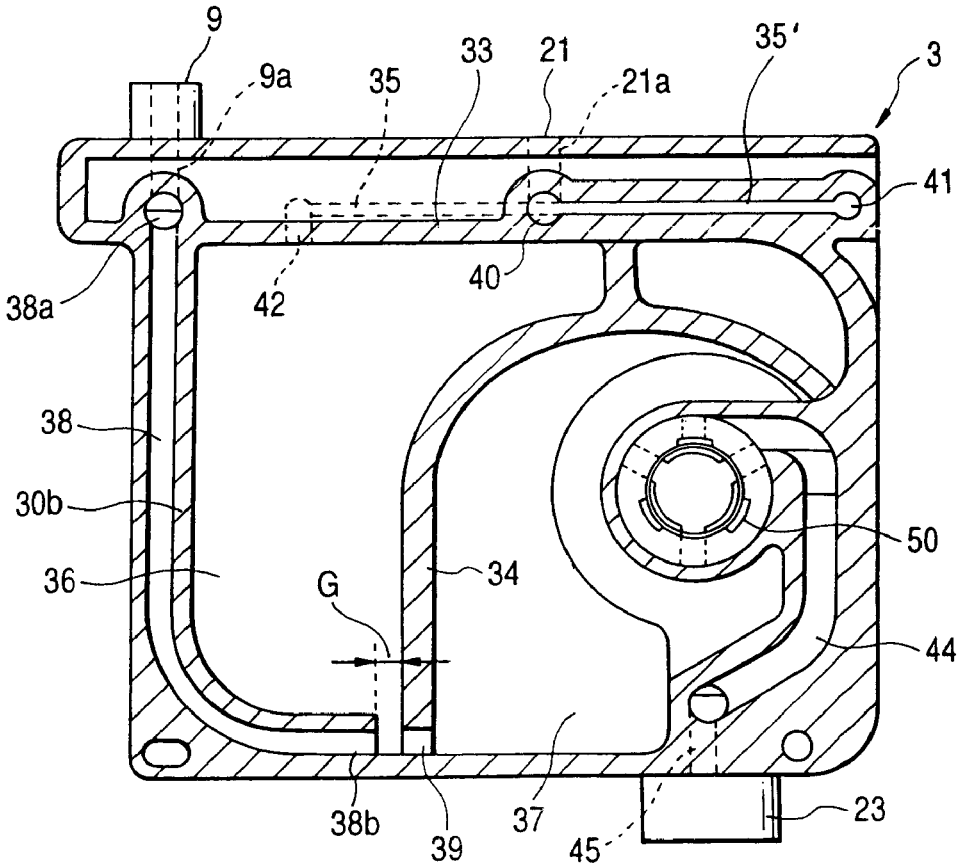
FIG. 4 is a sectional view showing the structure of the cross section viewed along a ling A-A shown in FIG. 2.

The casing 30 is divided vertically by a wall 33, and laterally by a wall 34 as shown in FIG. 4, so that thin grooves 35 and 35' for communicating with the air are provided in the upper wall 33, and the lower part is divided into the ink storage chamber 36 and a valve chamber 37. A thick part 30*b* extended from the side to the bottom is formed on one side 30*a* of the valve chamber 37 of the casing 30 to define an ink supply passage 38 in the form of a groove having an upper end 38*a* communicated with the ink inlet 9, and a lower end 38*b* apart from an ink inflow port 39 of the wall 34 by a gap G. The groove is offset in the direction of the thickness of the casing 30.

By locating the lower end of the ink supply passage 38 in the vicinity of the ink inflow port 39 in this manner, highly degassed ink injected from the ink cartridge 5 can flow to the recording head 4 via the ink supply passage 38 located in the lower part while avoiding contact with the air.

By allowing ink to flow into the recording head 4 while the degassed rate thereof is not lowered as described above, the highly degassed ink can be used to fill the recording head 4 and clean the recording head 4. Therefore, air bubbles existing in the recording head 4 can be easily dissolved in ink and discharged therefrom.

The upper end 38*a* of the ink supply passage 38 is connected to the ink inlet 9 via a communicating hole 9*a* formed through the casing 30. The air open port 21 is connected to a communicating hole 42 on the lower surface of the wall 33 via a communicating hole 21*a* formed through the casing 30, the thin grooves 35 and 35' formed on respective surfaces of the wall 33 and holes 40 and 41 extended in the thickness direction of the thickness for connecting these thin grooves 35 and 35', and therefore communicated with the ink storage chamber 36. That is, an air communication fluid passage is defined as a capillary increasing fluid resistance as much as possible with the aid of the holes 40 and 41 extended in the thickness direction and spaced from each other horizontally along the wall 33 and the thin grooves 35 and 35' that have the ends connected through the these holes and that are located on the respective sides of the wall 33. The inside of the ink storage chamber 36 is communicated with the air via the communicating hole 42, the thin groove 35, the hole 41, the thin groove 35', the hole 40 and the communicating hole 21*a* in this order.

The valve chamber 37 is divided into two areas in the thickness direction by a differential pressure valve mechanism 50 described later. A groove 43 is formed on a surface of an ink flow-in side to define a vertical ink flow passage that is communicated at its one end with the ink storage chamber 36 via an ink inflow port 39, and that is communicated at its the other end with the differential pressure valve mechanism 50. A groove 44 is formed in an ink flow-out side to define an ink flow passage for connecting the differential pressure valve mechanism 50 to the ink supply port 23. The leading end of the groove 44 is communicated with the ink supply port 23 via a vertical through-hole 45 formed through the casing 30.

Figure 5:
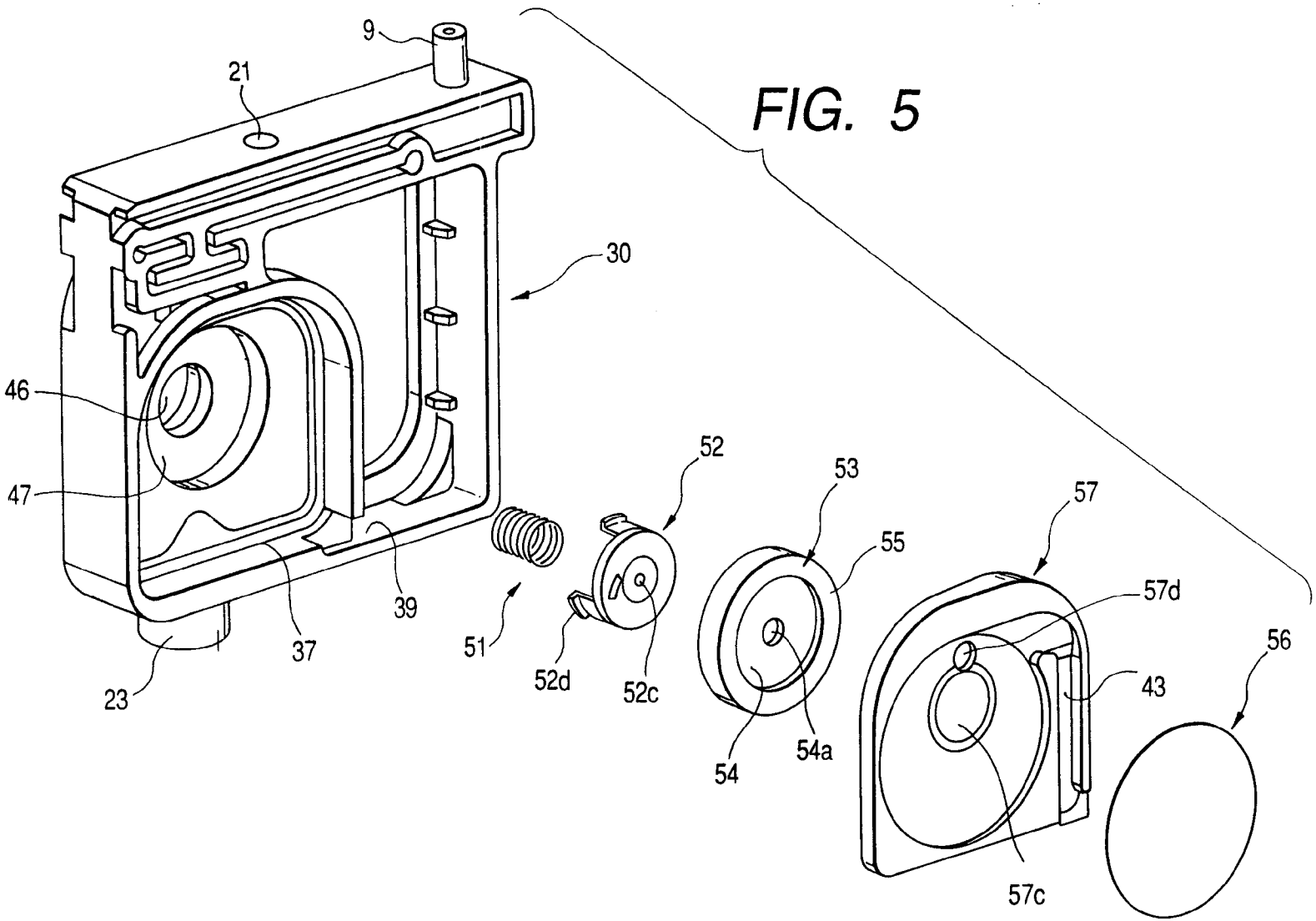
FIG. 5 is an assembly perspective view showing an embodiment of a differential pressure valve mechanism built in the ink supply unit.
Figure 6B:
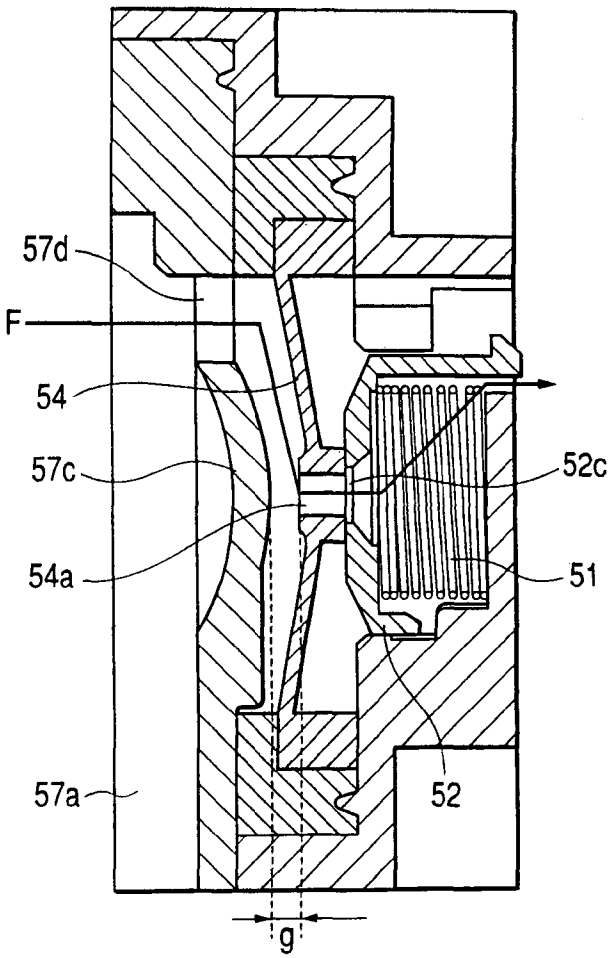
FIGS. 6 (*a*) and 6 (*b*) are sectional views showing the differential pressure valve mechanism of the ink supply unit with the mechanism enlarged, FIG. 6 (*a*) shows a state in which the valve is closed and FIG. 6 (*b*) shows a state in which the valve is open.
Figure 6A:
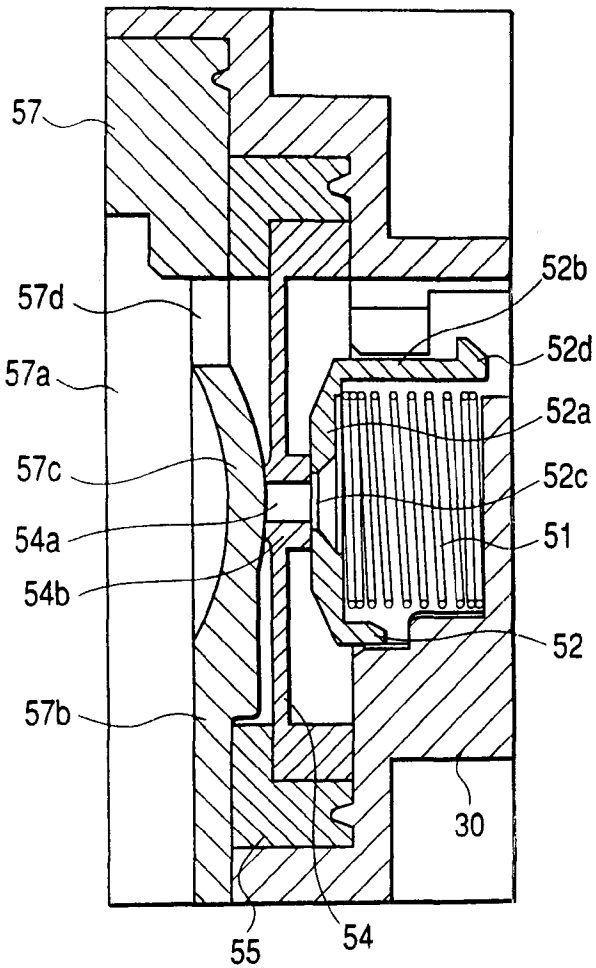
Figure 7A:
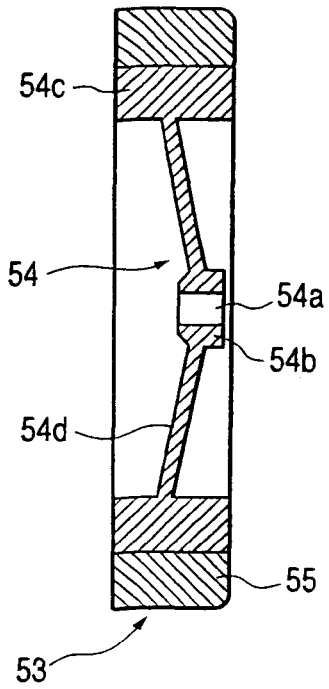
FIGS. 7 (*a*) to 7 (*e*) are sectional views respectively showing other embodiments of the membrane valve forming the differential pressure valve mechanism.
Figure 7B:
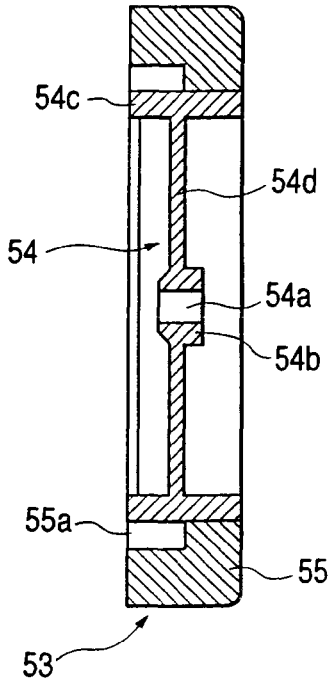
Figure 7C:
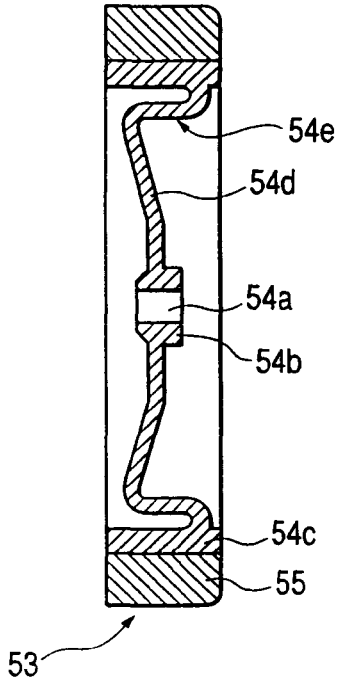
Figure 7D:
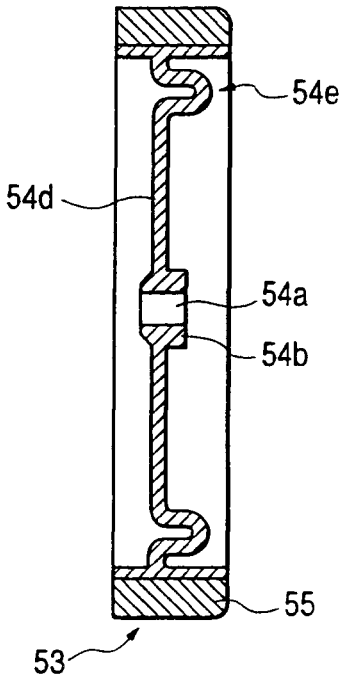
Figure 7E:
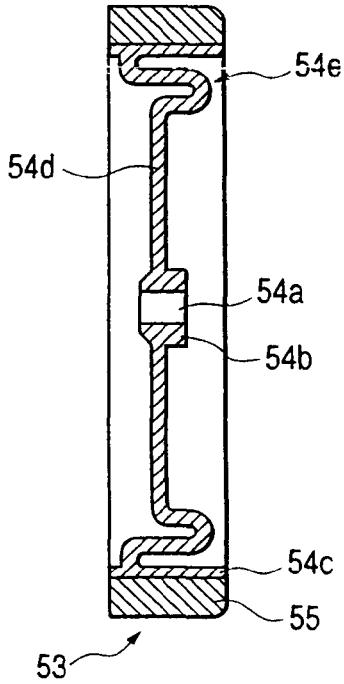

FIGS. 5 and 6 show an embodiment of the above-mentioned differential pressure valve mechanism 50. A valve assembly accommodating recess 47 having a hole 46 for accommodating a coil spring 51 therein is formed in the central area of a side wall sealing one side of the valve chamber 37 of the casing 30, and the coil spring 51, a spring holder 52, a membrane valve 53 and a fixing member 57 used also as a support member for a filter 56 are fitted therein in a laminated fashion. The spring holder 52 is provided with a spring support face 52*a* around which guide pieces 52*b* with removal preventive claws 52*d* are formed. An ink flow port 52*c* is formed through the spring support face 52*a*.

The membrane valve 53, designed as a movable valve, includes a membrane part 54 formed of flexible material to be elastically deformed by receiving differential pressure, and a thick fixed part 55 that supports the periphery of the membrane part 54, that is formed of hard material and that is held between the casing 30 and the fixing member 57. It is preferable to manufacture the membrane valve 53 integrally through two-color molding of high polymer materials. At the central part of the membrane part 54, a thick sealing part 54*b* is provided, which has an ink flow port 54*a* opposite to the ink flow port 52*c* of the spring holder 52.

The fixing member 57 is formed with a recess 57*a* to form a filter chamber. A valve seat 57*c* is formed at the central part of a sealing wall 57*b* of the recess 57*a* to come in contact with the ink flow port 54*a* of the membrane valve 53. The valve seat 57*c* is formed into a spherical shape to be protruded toward the membrane valve 53. A through-hole 57*d* is provided above the valve seat 57*c*, through which ink flows in.

In this embodiment, when the carriage 1 is moved to the position of the ink supplementing unit 7 and the ink supply unit 3 is connected to the ink supplementing unit 7, the ink inlet 9 is connected to the ink cartridge 5 via the tube 8 and the air open port 21 is connected to the pump unit, which is an ink injecting pressure source, via the tube 11.

When the ink supplementing unit 7 is operated in this state, pressure in the ink storage chamber 36 is decreased to cause ink to flow into the bottom of the ink storage chamber 36 via the ink supply passage 38.

As the membrane part 54 of the membrane valve 53 is pressed by the spring 51 and elastically contacted with the valve seat 57*c* as shown in FIG. 6 (*a*) in a state where the ink storage chamber 36 is filled with ink in this manner, the communication between the ink storage chamber 36 and the ink supply port 23 is cut off.

When printing is started in this state and ink is consumed by the recording head 9, pressure in the groove 44 forming the ink passage is decreased to maintain ink supplied to the recording head 9 at fixed negative pressure. As ink is further consumed, negative pressure is increased. Therefore, differential pressure acting on the membrane part 54 is increased as shown in FIG. 6 (*b*), the membrane part 54 retracts against the spring 51 to separate the ink flow port 54*a* from the valve seat 57*c*, thereby forming a gap g.

This permits ink in the ink storage chamber 36 to flow into the valve chamber 37, pass through the ink flow port 54*a* of the membrane part 54 after air bubbles and dusts are removed therefrom by the filter 56, and then flow into the ink supply port 23 along a flow line shown by F. When differential pressure is decreased down to a certain degree in this manner, the membrane part 54 of the membrane valve 53 is pushed back to the valve seat 57*c* by the spring 51 to close the ink flow port 54*a* as shown in FIG. 6 (*a*).

This operation is repeated to supply ink to the recording head while maintaining constant negative pressure, that is, as the negative pressure of the ink supply port 23 is increased, the membrane valve 53 retracts against the coil spring 51 to open the ink flow port 54*a*.

According to this embodiment, since the vicinity of the periphery of the ink flow port 54*a* of the membrane valve 53 is positively pressed onto the valve seat 57*c* by the coil spring 51, the fluctuation of the membrane valve 53 associated with the movement of the carriage is inhibited and the supply pressure of ink to the recording head can be stably kept at a predetermined negative pressure, compared with a conventional type ink supply unit which adjusts differential pressure only by the elasticity of the membrane valve 53.

FIGS. 7 (*a*) to 7 (*e*) respectively show other embodiments of the above-described membrane valve 53. The membrane part 54 is made of material which can be displaced by the differential pressure of ink, for example, soft polypropylene so that it is provided with an annular support 54*b* in the periphery thereof and the thick sealing part 54*b* having the ink flow port 54*a* in the central part thereof. The fixed part 55 is formed of hard material, for example hard polypropylene, into an annular member that is fitted onto the periphery of the support 54*c* of the membrane part 54 to support the same.

In FIG. 7 (*a*), a thin part 54*d* forming the elastically deformable area of the membrane part 54 is tapered to offset the sealing part 54*b* relative to a position where the thin part 54*d* and the support 54*c* are connected together.

In FIG. 7 (*b*), the thin part 54*d* is designed so that the connection thereof to the support 54*c* and the center thereof are located on the same plane, and the thin part 54*d* is located approximately in the center of the thickness direction of the support 54*c* (or the fixed part 55). Further, the fixed part 55 is provided with an annular recess 55*a* that is to be located in a side where the sealing part 54*b* comes in contact with the valve seat 57*c* and that extends approximately to the connection area between the thin part 54*d* and the support 54*c*, so as not to hinder the elastic deformation of the membrane part 54 and so as to maintain the support force.

In each of FIGS. 7 (*c*) to 7 (*e*), an annular-bent part 54*e* is formed in the connection area between the thin part 54*d* and the support 54*c* to release the force of constraint of the thin part 54*d* by the support 54*c* and to absorb deformation caused by shrinkage stress associated with injection molding.

In FIG. 7 (*c*), the bent part 54*e* is formed into a tubular shape, and the support side of the thin part 54*d* and the ink flow port 54*a* side thereof are displaced from each other.

Further, in FIG. 7 (*d*), the bent part 54*e* is formed into a U-shape in section, and the support 54*c* and the ink flow port 54*a* are located on the same plane.

Further, in FIG. 7 (*e*), the bellows part having a U-shaped section is formed such that the support side thereof is displaced toward the side where the sealing part 54*b* comes in contact with the valve seat.

Figure 8A:
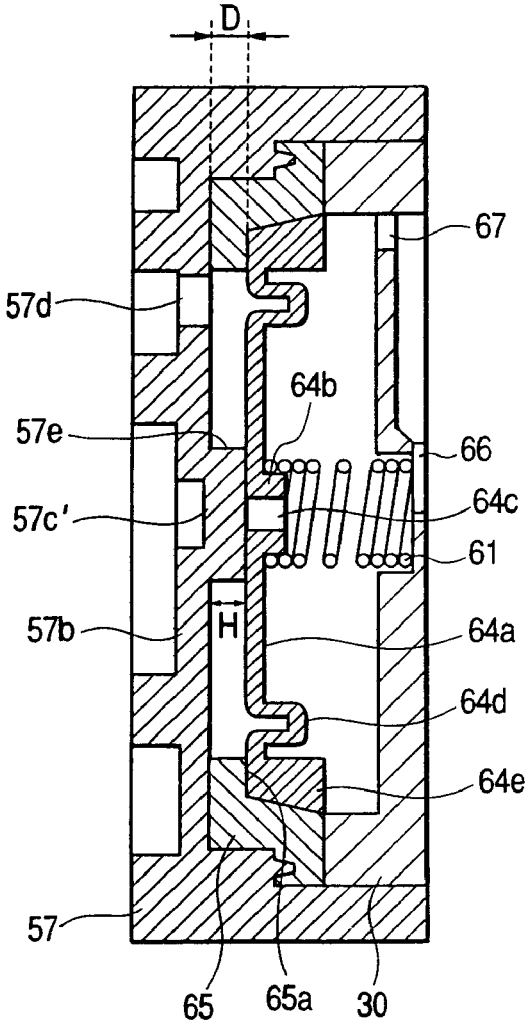
FIG. 8 are sectional views showing other embodiments of the differential pressure valve mechanism with the mechanism enlarged, FIG. 8 (*a*) shows a state in which the valve is closed, FIG. 8 (*b*) shows a state in which the valve is open and FIG. 8 (*c*) is a sectional view showing the other embodiment of the valve.
Figure 8B:
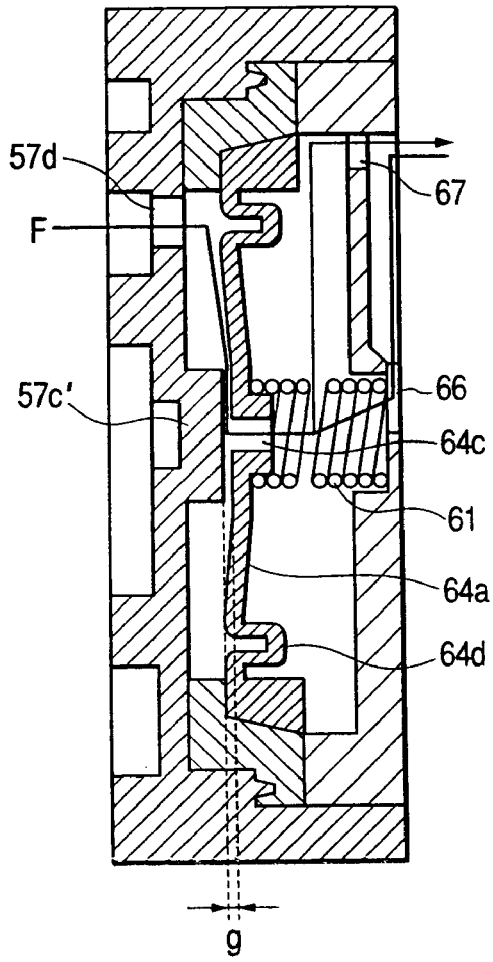
Figure 8C:
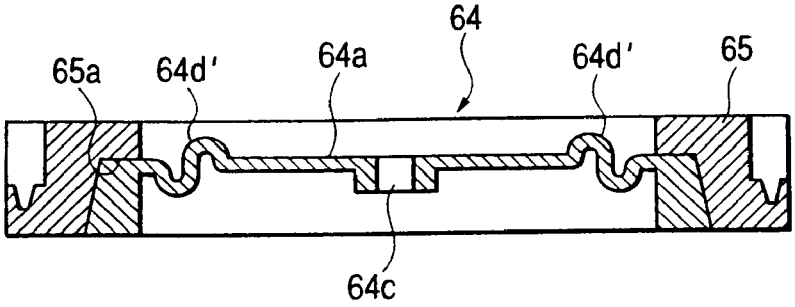

FIG. 8 show another embodiment of the differential pressure valve mechanism. In this embodiment, a differential pressure adjusting spring 61 elastically presses a membrane part 64 without using a casing. That is, the membrane part 64 includes a thin part 64*a* defining a flat surface on a side facing a valve seat 57*c*' of a fixing member 57, a protruded portion 64*b* on a side opposite from the side facing the valve seat 57*c*' for positioning the spring 61 fitted on the periphery thereof, and an ink flow port 64*c* formed through the central part.

An annular bent part 64*d* having a U-shape in section is formed in the supported area side of the thin part 64*a*, and a thick support part 64*e* is formed in an outer periphery thereof. A flanged fixing part 65 integral with the support part 64*e* by hard material is formed in the periphery of the support part 64*e*. The leading end side, i.e. the surface facing valve seat 57*c*', of the support part 64*e* is supported by the bottom 65*a* of the fixing part 65 so that the position thereof in the thickness direction is regulated.

In this embodiment, the valve seat 57*c*' of the fixing member 57 is in the form of a protrusion defining a planar surface facing the membrane part 64 and having an outer edge 57*e* located outside the outer periphery of the spring 61. The height H of the valve seat 57*c*' is set to be equal to the thickness D of the bottom 65*a* of the fixing part 65. This allows the surfaces facing the fixing part 65 and the valve seat 57*c*' to be located approximately on the same plane, thereby making it possible to contact/separate the membrane part 64 with/from the valve seat 57*c*' in response to the minute consumed quantity of ink by the recording head 4.

In this embodiment, in a state in which ink is filled, the membrane part 64 is pressed by the spring 61 to elastically contact the valve seat 57*c*' over an extremely large area as shown in FIG. 8 (*a*). Therefore, the communication between the ink storage chamber 36 and the ink supply port 23 is cut off. As printing is started in this state to consume ink by the recording head 9, a gap g is formed between the membrane part 64 and the valve seat 57*c*' as shown in FIG. 8 (*b*). This permits ink in the ink storage chamber 52 to flow into the ink supply port 23 as shown by F such the ink, from which air bubbles and dusts are removed by the filter 56, passes through the ink flow port 64*c* of the membrane part 64 and an outflow port 67. In this manner, when differential pressure is decreased to some extent, the membrane part 64 is pushed back to the valve seat 57*c*, by the spring 61 and the ink flow port 64*c* is closed as shown in FIG. 8 (*a*). As the pressure of the spring 61 is received by the valve seat 57*c*' in this state, the thin part 64*a* is not deformed excessively and fluid-tight property can be kept for a long term.

Soft high polymer material is likely to cause contraction, etc. subsequently to injection molding, and the thin part 64*a* may faces a difficulty to keep a planar surface. To cope with this difficulty, an annular bent part 64*d*' having a approximately S-shape in section is formed in the support area side of the thin part 64*a* as shown in FIG. 8 (*c*) to keep the thin part 64*a* planar.

Figure 9:
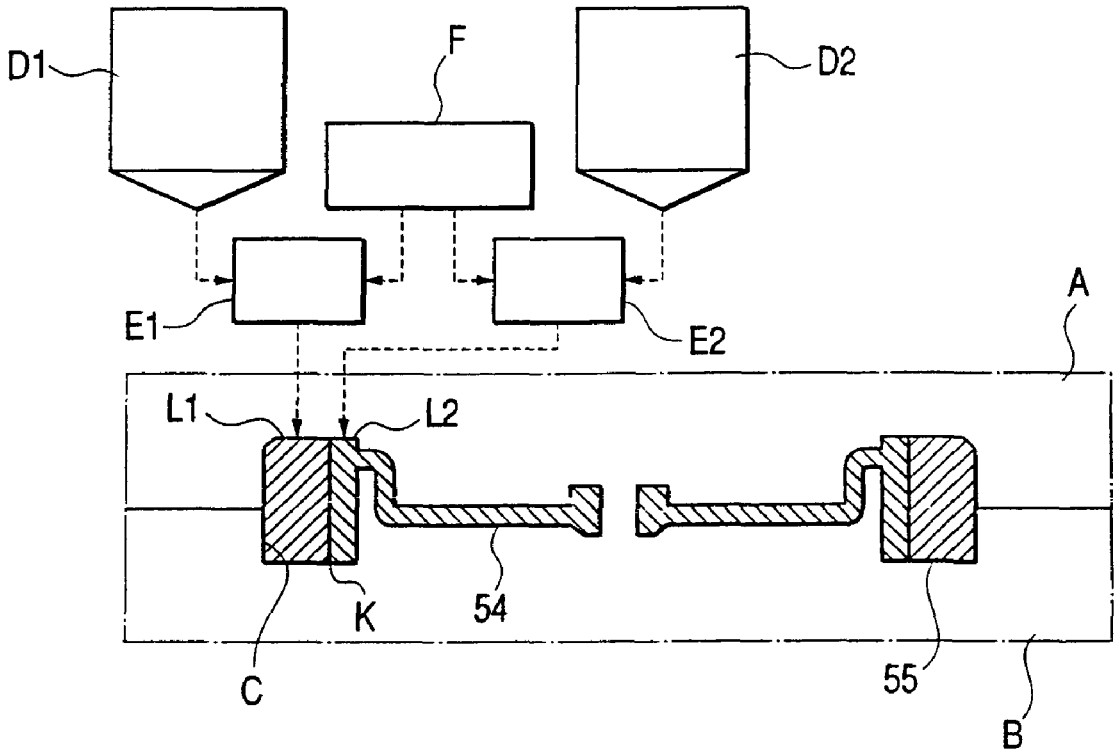
FIG. 9 shows an embodiment of a method of manufacturing the above valve.

FIG. 9 shows an embodiment of an apparatus for manufacturing the membrane valve. Molding dies A and B defining a mold cavity C corresponding in shape to the entire configuration of the membrane valve 53 are prepared. A first injection port L1 is provided at a radially outer side with respect to a ring part K, whereas a second injection port L2 is provided at a radially inner side. A hard polypropylene injection molding machine D1 and a soft polypropylene injection molding machine D2 are respectively connected via valves E1 and E2 the opened or closed time of which is controlled by a timer F.

The molding dies A and B are rotated about an area to be formed as the ink flow port, and the first valve E1 is opened to inject hard polypropylene by predetermined quantity. The injected hard polypropylene is uniformly distributed in the outside by receiving centrifugal force and thus formed into an annular shape. After the hard polypropylene is hardened to some extent, the second valve E2 is opened to inject soft polypropylene, so that the soft polypropylene is molded into the shape of the mold dies while being closely contacted with the inside of the annular hard polypropylene.

Figure 10:
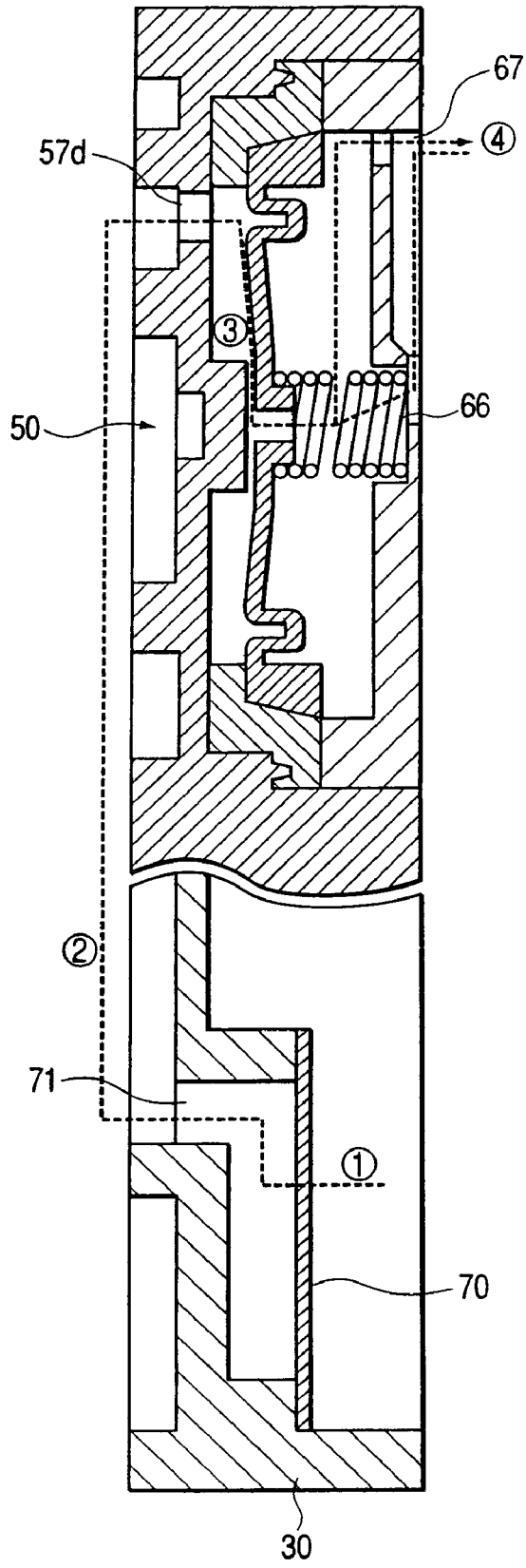
FIG. 10 shows relationship between a filter and a passage in case in which the filter attaching position is changed from the embodiment shown in FIG. 8 in a state in which the valve is open and FIGS. 11 (*a*) and 11 (*b*) respectively show respective sides of the ink supply unit to show a groove and a through hole forming the passage.

In the above embodiments, the filter is disposed to face the differential pressure valve mechanism, however, as shown in FIG. 10, the similar effect is obtained even if the filter is disposed at a position not facing the differential pressure valve mechanism, for example, at a position below the differential pressure valve mechanism 50. That is, it suffices that the ink storage chamber 36 is communicated with one surface of a filter 70, and the other surface of the filter 70 is communicated with the ink inflow port of the differential pressure valve mechanism 50 via a through-hole 71 formed in a thick portion of the casing 30.

Figure 11A:
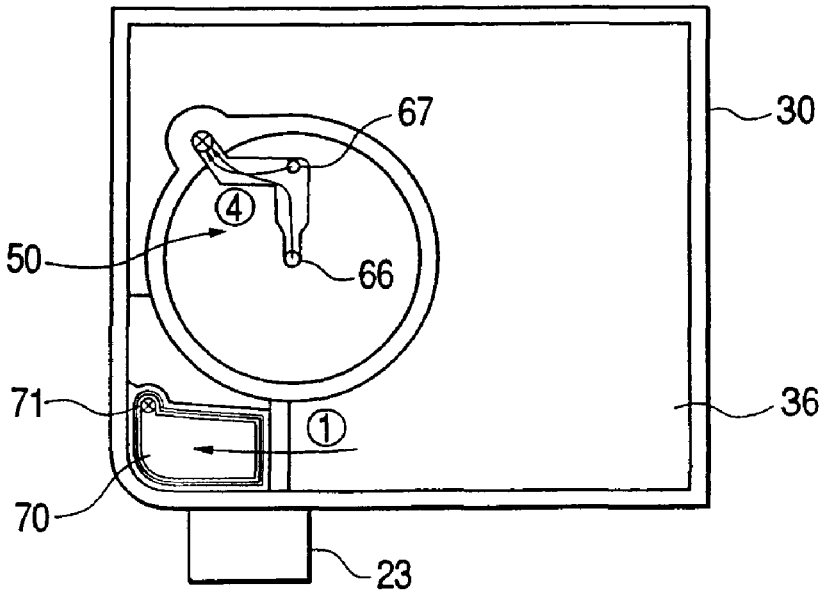
Figure 11B:
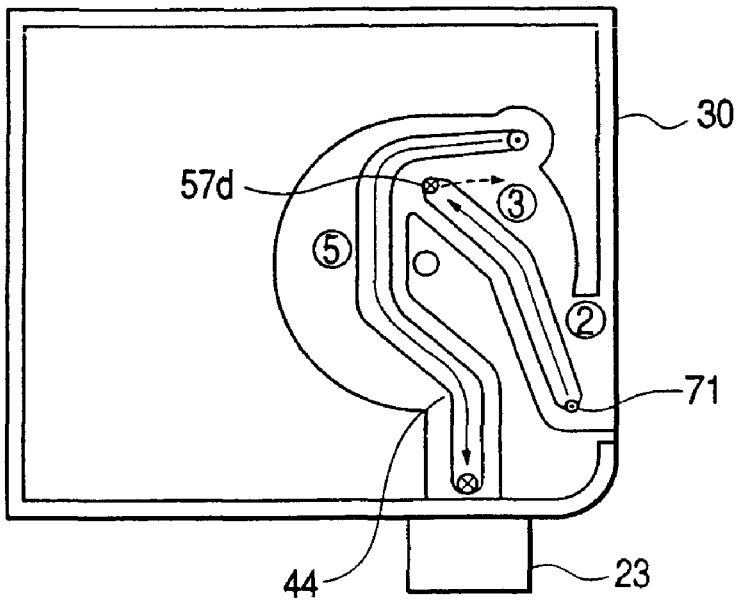

FIGS. 11 (*a*) and 11 (*b*) respectively show the flow of ink in the above embodiment on the surface and the backface of the casing 30. The communication is established by flow (1) from the ink storage chamber 36 to the filter 70, flow (2) from the through-hole 71 via a passage formed in the casing to the inflow port 57*d* of the differential pressure valve mechanism 50, flow (3) passing through the membrane valve, flow (4) passing through a passage connecting the outflow ports 66 and 67 of the differential pressure valve mechanism 50 to the ink supply port 23 and flow (5) flowing the passage 44. A mark having a dot in a circle in the drawings shows flow perpendicular to the paper surface and toward a reader, whereas a mark having x in a circle shows flow perpendicularly to the paper surface and away from the reader.

Figure 12:
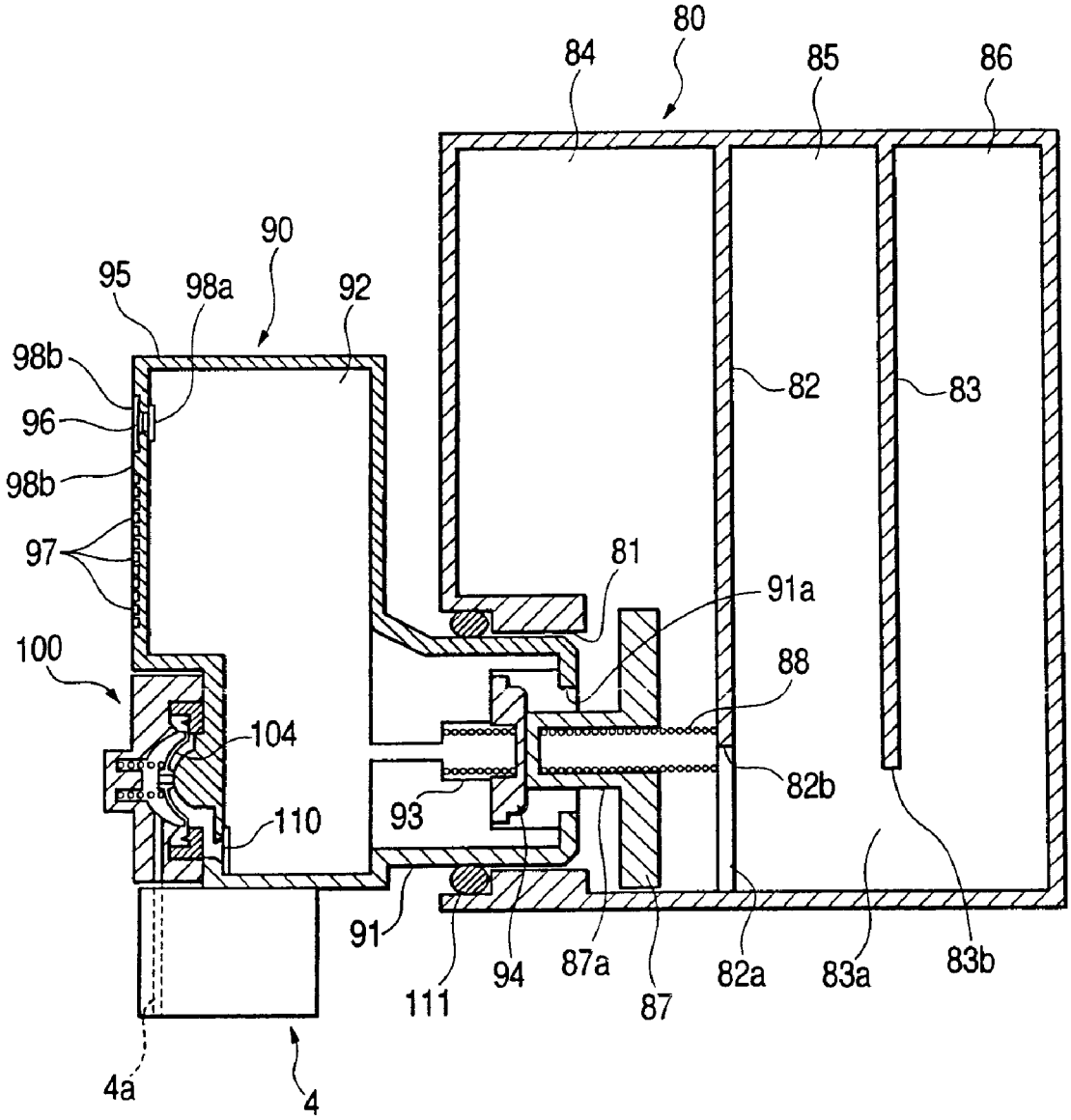
FIG. 12 is a sectional view showing another embodiment of the present invention and FIG. 13 is a sectional view enlarging the differential pressure valve mechanism.

FIG. 12 shows an embodiment in which a main ink tank is directly connected to an ink supply unit.

A main tank 80 is formed at the bottom of one side thereof with a connection port 81 to which an ink supply unit 90 is connected. The inside of the main tank 80 is divided into plural chambers, e.g. three first to third ink chambers 84, 85 and 86 by two partitions 82 and 83 in this embodiment. The lower parts of the partition 82 and 83 are respectively formed with communicating ports 82*a* and 83*a*, where the upper surfaces 82*b* and 83*b* are set to be lower than the upper end of the connection port 81 and to be gradually lowered as they are apart from the connection port 81 for the ink supply unit.

A sealing valve 87 is provided in the connection port 81, which has a projection 87*a* on the outer side and which is constantly biased toward the connection port 81 by a spring 88 having one end supported by the partition 82.

The ink supply unit 90 is formed as a container forming an ink storage chamber 92 communicating with a tubular connection part 91 which can be inserted into the connection port 81 of the main tank 80 in a fluid-tight state. The connection part 91 is located at the lower part of the ink supply unit 90. The other surface opposite to the connection part 91 is provided with a differential pressure valve mechanism 100 described later. The connection part 91 is provided with an opening 91*a* into which the projection 87*a* of the sealing valve 87 can be inserted, and a valve 94 biased by a spring 93 is inserted therein so that the valve 94 can be moved back and forth. The spring 93 is set so that it is weaker than the spring 88 in the connection port 81.

A communicating hole 96 is provided in an exposed wall 95 of the container defining the ink storage chamber 92 so that the communicating hole is located above the surface of ink in the ink storage chamber 92. A groove 97 is formed on the surface side of the wall, and connected to the communicating hole 96. An area where the communicating hole 96 is provided is sealed by a film 98*a* having repellent property and gas permeability to prevent ink from entering into the groove 97. The groove 97 is sealed by an air intercepting film 98*b* so that they form a passage communicating with the air.

Figure 13:
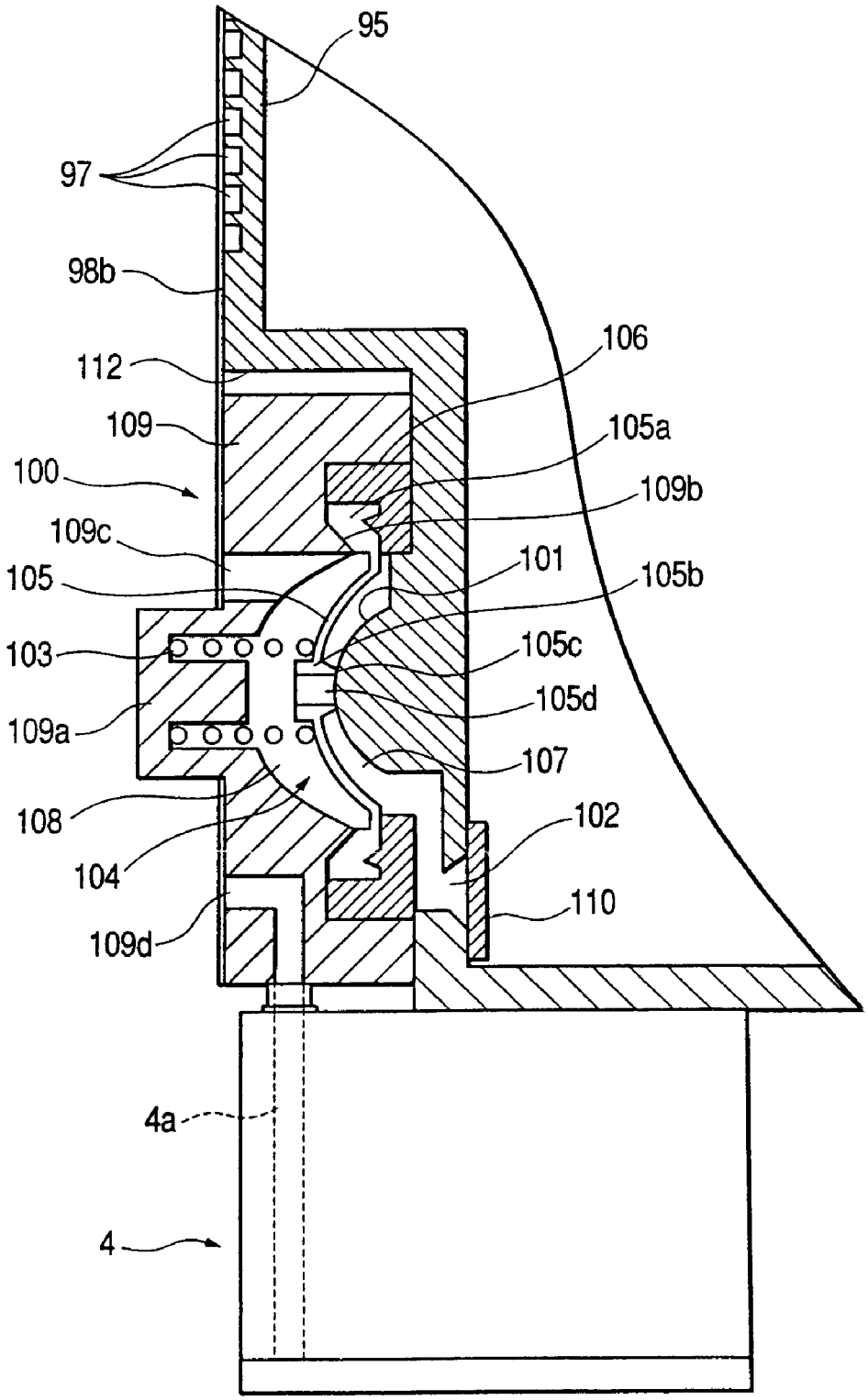

The differential pressure valve mechanism 100 is provided to a passage connecting the ink storage chamber 92 to an ink guidepath 4*a* of the recording head 4. As shown in FIG. 13, a spherical convex valve seat 101 is formed on the lower end of the wall 95, and an ink inflow port 102 is formed in an area at the lower end thereof. A membrane valve 104 is biased by a coil spring 103 to come in contact with the center of the valve seat 101.

The membrane valve 104 designed as a movable membrane is elastically deformable by the differential pressure of ink, and includes a membrane part 105 defining a spherical surface larger in radius than the valve seat 101, and an annular fixed part 106 integral with a fixed part 105*a* on the periphery of the membrane part 105. A first ink chamber 107 is defined between the membrane valve 104 and the valve seat 101.

A protruded part 105*b* for engagement with the coil spring 103 is formed on the protruded side of the center of the membrane part 105, and a sealing part 105*c* for contact with the protruded end of the valve seat 101 is formed on the opposite back surface. An ink inflow port 105*d* is formed to penetrate these parts.

The membrane valve 104 and the spring 103 are fixed by a valve fixing frame 109 provided with a recess for defining a second ink chamber 108. A passage connecting the second ink chamber 108 to the ink guidepath 4*a* of the recording head 4 is constructed by a through-hole formed through the valve fixing frame 109, or constructed such that grooves 109*c* and 109*d* are provided on the surface and the grooves 109*c* and 109*d* are sealed by a film (in this embodiment, a film 98*b* on the wall 95 forming the ink storage chamber 92 is used). The valve fixing frame 109 can be securely fixed by sharing the film 98*b* on the wall 95 of the ink storage chamber 92 in this manner. A reference number 110 denotes a filter provided to the ink inflow port 102, and 111 denotes packing for sealing.

Such a differential pressure valve mechanism 100 can be assembled such that the spring 103 is fitted on a spring holding protrusion 109*a* of the valve fixing frame 109, the fixed part 105*a* of the membrane part 105 is aligned with a tapered groove 109*b*, the annular fixed part 106 is fitted between the outer periphery of the fixed part 105*a* and the groove 109*b*, and an integral unit of these are fixed to a recess 112.

In the embodiment thus constructed, the membrane part 105 is pressed by the spring 103 to come in contact with the hemispherical valve seat 101 while being elastically deformed, and ink is supplied to the recording head 4 while maintaining differential pressure set by the spring 103 similarly to the aforementioned embodiments.

Next, the connection of the main tank 80 to the ink supply unit 90 constructed as described above will be described.

Figure 14A:
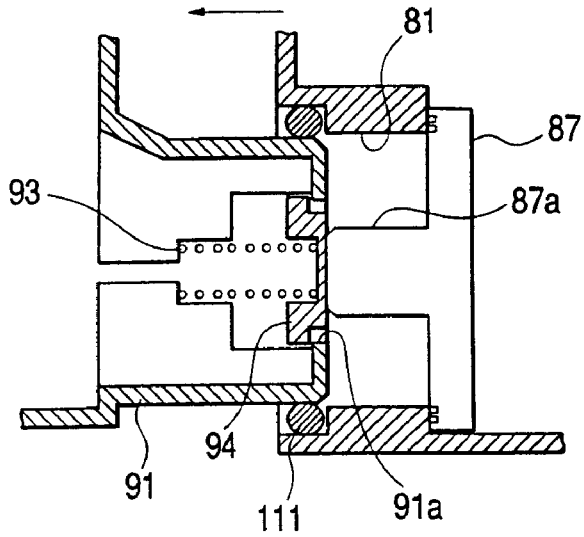
FIGS. 14 (*a*) to 14 (*c*) respectively show the operation of a connection in a process for installing a main tank in the ink supply unit and FIGS. 15 (*a*) to 15 (*c*) respectively a state in which ink is supplemented from the main tank in association with ink consumption by a recording head.
Figure 14B:
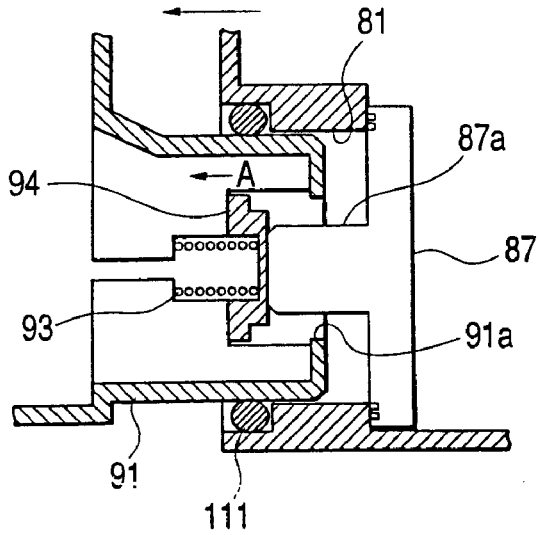
Figure 14C:
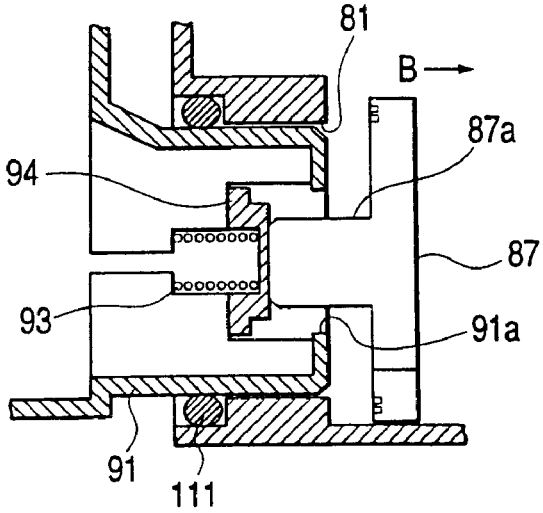

The connection port 81 of the main tank 80 is aligned with the connection part 91 of the ink supply unit 90 to establish a state in which air tight is kept by the packing 111 of the connection port 81 as shown in FIG. 14 (*a*).

The further depression in this state causes the protruded portion 87*a* to move the valve 94 backwardly to a limit point in a direction shown by an arrow A against the spring 93 of the connection part 91, thereby opening a passage as shown in FIG. 14 (*b*).

Further, when the main tank 80 is depressed further, the valve 94 supported at the limit point, in turn, depresses the protruded portion 87*a* backwardly in a direction shown by an arrow B against the spring 88 to separate the sealing valve 87 from the connection port 81, thereby releasing the passage as shown in FIG. 14 (*c*). This permits ink in the main tank 80 to flow into the ink storage chamber 92 of the ink supply unit 90 as shown in FIG. 15 (*a*).

When ink is consumed by the recording head 4 in this state and pressure in the chamber 108 communicating with the recording head 4 is decreased, the membrane part 105 is separated from the valve seat 101 against the spring 103. This permits ink in the chamber 107 to flow into the chamber 108. Supplementing ink lowers negative pressure in the chamber 108, that is, differential pressure is decreased down to pressure suitable for supplying ink to the recording head 4, so that the membrane part 105 is pushed back by the spring 103. This causes the valve seat 101 to close the ink inflow port 105*d*, thereby maintaining negative pressure in the chamber 108 at a predetermined value.

Figure 15A:
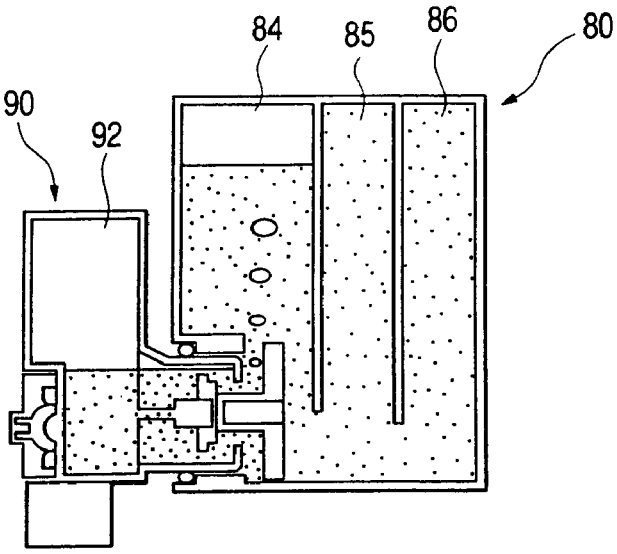
Figure 15B:
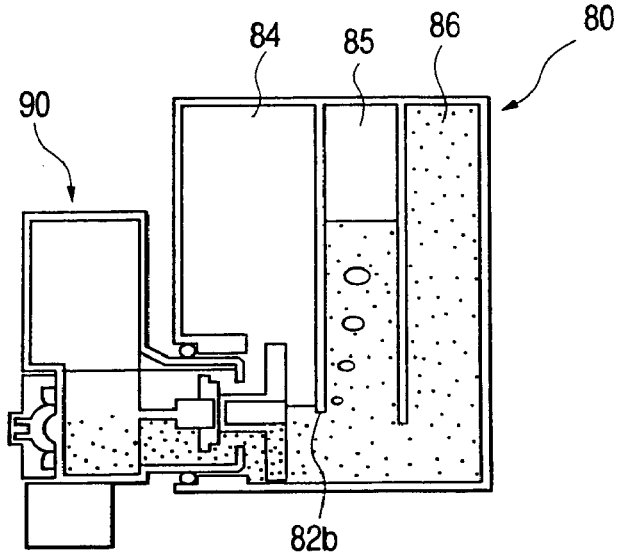
Figure 15C:
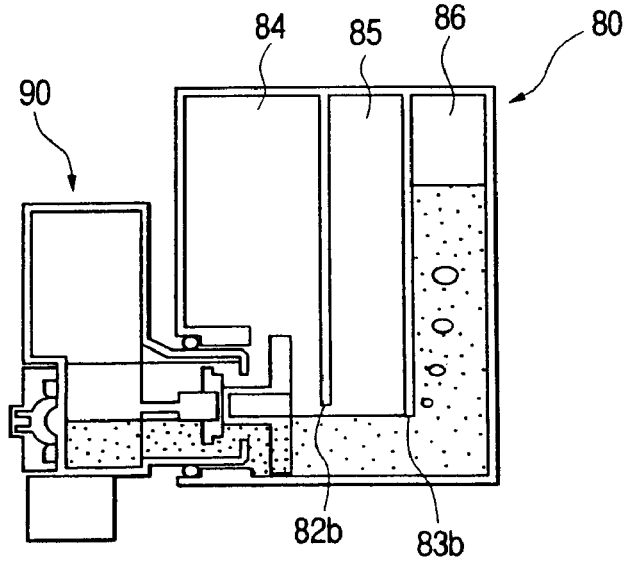
Figure 16A:
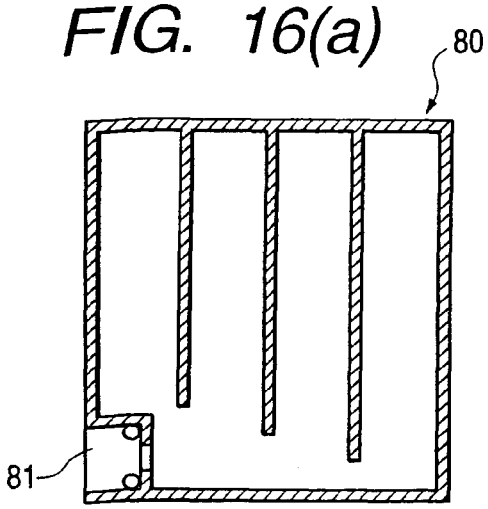
FIGS. 16 (*a*) to 16 (*e*) respectively show other embodiments of the main tank.
Figure 16B:
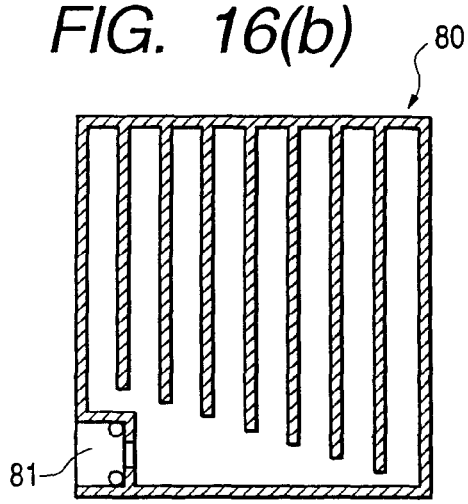
Figure 16C:
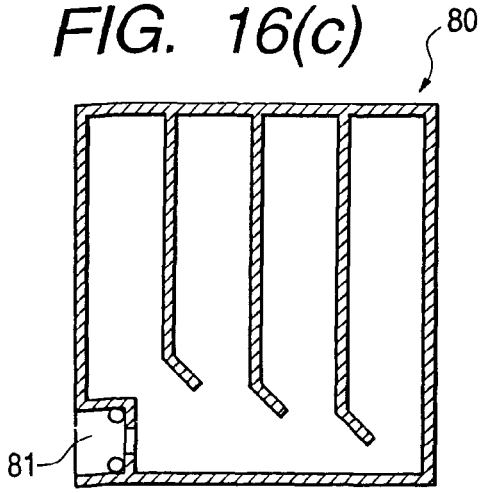
Figure 16D:
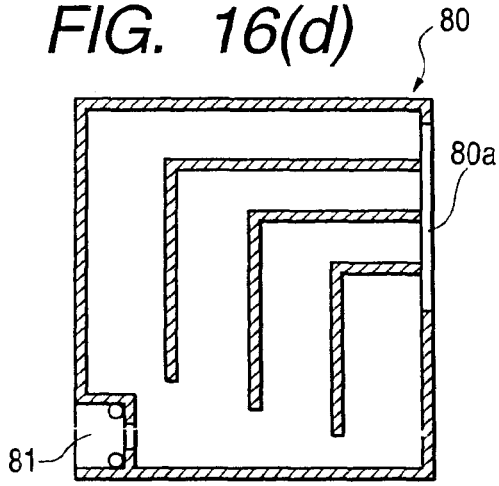
Figure 16E:
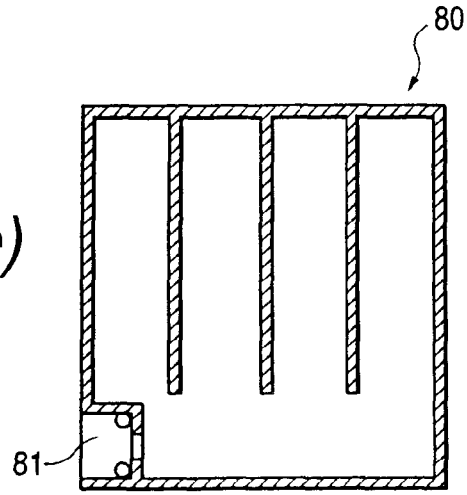

When ink is consumed in this manner and the level of ink in the first ink chamber 84 lowers to the upper end 82*b* of the window 82*a* of the partition 82, ink in the second ink chamber 85 is consumed as shown in FIG. 15 (*b*). When the level of ink in the second ink chamber 85 lowers to the upper end 83*b* of the window 83*a* of the partition 83, ink in the third ink chamber 86 is consumed as shown in FIG. 15 (*c*).

With this construction, the change of an ink level in the ink storage chamber 92 can be suppressed smaller than the change of an ink level in the main tank 80 in association with the ink consumption. Therefore, the variation of pressure can be reduced. To cope with a problem that ambient temperature increase causes expansion of air in the main tank 80 to push out ink and vary the ink level in the ink storage chamber 92, the presence of the upper end 82*b* of the window 82*a* of the partition 82 can reduce the volume of air in the main tank 80, which does not communicate with the ambient air, and therefore the supply pressure of ink to the recording head can be stably kept.

In such a process, the vapor of ink in the ink storage chamber 92 is prevented from being evaporated in the ambient air by the capillary made up of the groove 97 and the film 98. On the other hand, the quantity of increased pressure in the ink storage chamber 92 caused by the ambient temperature increased is released to the ambient air via the capillary made up of the communicating hole 96 in the upper part of the ink storage chamber 92, the groove 97 and the film 98 so that pressure in the ink storage chamber 92 is released.

FIG. 16 show other embodiments of the main tank. In the above embodiment, the main tank is divided into three ink chambers, however, as shown in FIGS. 16 (*a*) and 16 (*b*), the main tank may be divided by three partitions or seven partitions, where the upper ends of communicating windows in the lower parts are positioned upper as the communicating windows are located closer to the connection port 81. As the volume of each ink chamber is set smaller in this manner, dynamic pressure by ink flow of ink associated with the change from one chamber to another chamber can be reduced.

As shown in FIG. 16 (*c*), if the lower end of the partition is tilted so that the lower end is located away from the connection port 81, dynamic pressure toward the connection port side by the ink flow of ink associated with the change from one ink chamber to another can be decreased. Further, as shown in FIG. 16 (*d*), the upper part of each partition is horizontally extended to form a top plate, and a wall 80*a* to which these top plates are extended is made at least translucent. This makes it possible to visually recognize consumption of ink in each ink chamber from the side. Further, as shown in FIG. 16 (*e*), even if communicating windows of the same height are used, approximately the similar effect is obtained.

Figure 17B:
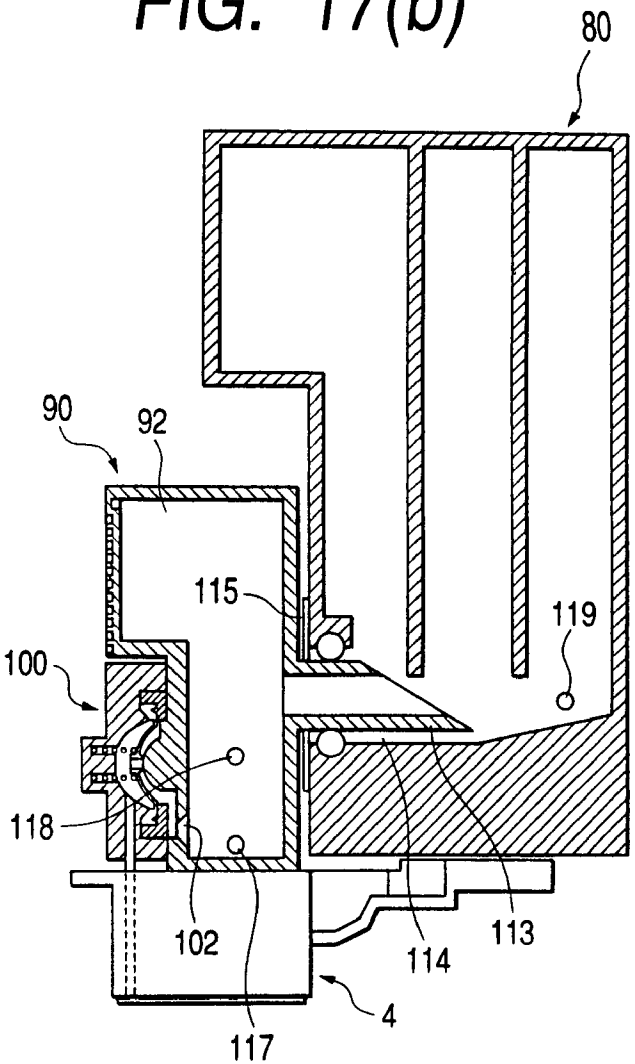
FIGS. 17 to 19 respectively show other embodiments of the main tank according to the present invention, and FIGS. 17 (*a*) and 17 (*b*), FIGS. 18 (*a*) and 18 (*b*) and FIGS. 19 (*a*) and 19 (*b*) respectively show a state before the main tank is installed in the ink supply unit and a state in which it is installed.
Figure 17A:
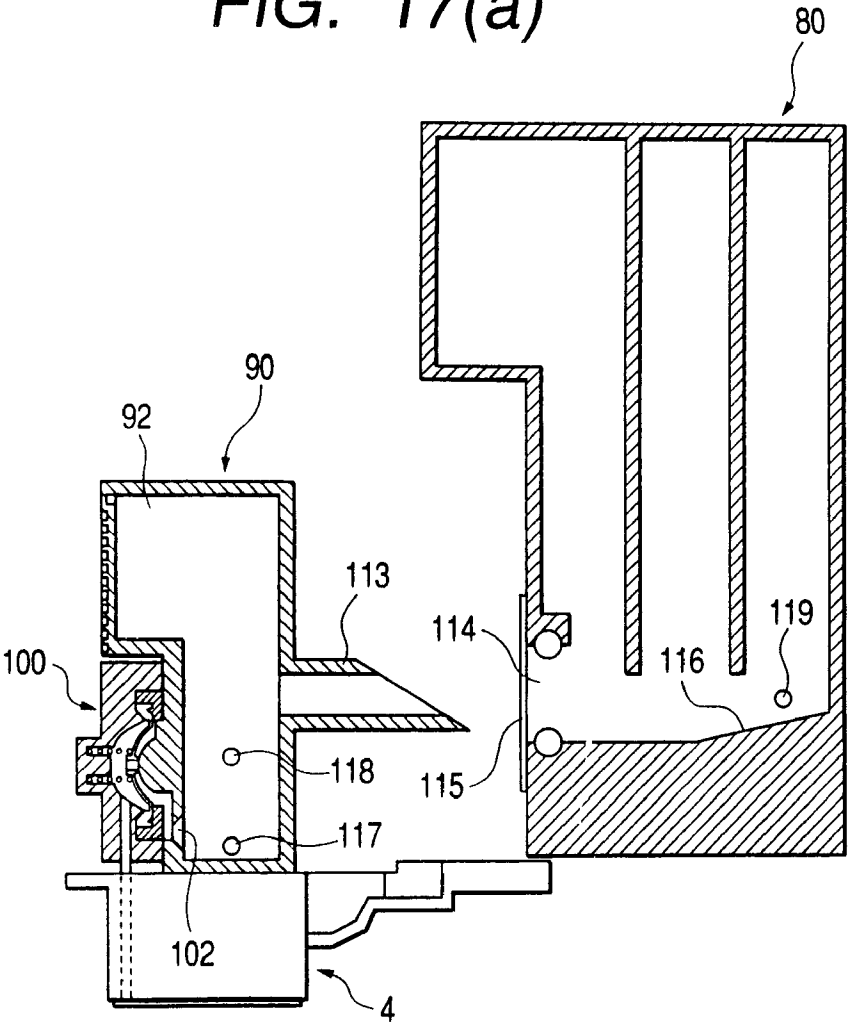

FIGS. 17 (*a*) and 17 (*b*) show another embodiment of the present invention. In this embodiment, a hollow needle 113 communicating with an ink storage chamber 92 is formed on the back surface of an ink supply unit 90, whereas an ink supply port 114 is formed in an ink cartridge 80 and sealed by a film 115 which the hollow needle 113 can pierce. In the ink cartridge 80, a bottom face 116 having a slant face which is higher as the slant face is distanced further from the ink supply port 114 is formed. In the ink storage chamber 92 of the ink supply unit 90, a first ink level detecting electrode 118 is arranged so that a common electrode 117 is located below the first ink level detecting electrode 118, and in the ink cartridge 80, a second ink level detecting electrode 119 is arranged above the first ink level detecting electrode 118 and at a position where the second ink level detecting electrode 119 is exposed when no ink exists in the ink cartridge 80. The common electrode 117 is, preferably, arranged so that it is located below an ink inflow port 102.

According to this embodiment, as shown in FIG. 17 (*b*), when the hollow needle 113 is aligned with ink supply port 114 of the ink cartridge 80 and pushed thereto, the hollow needle 113 pierces the film 115 to permit ink in the ink cartridge 80 to flow into the ink storage chamber 92 of the ink supply unit 90.

If ink consumption progresses due to printing, etc. until ink in the last chamber 86 of the ink cartridge has been consumed, the second ink level detecting electrode 119 is exposed in the air, and conduction to the common electrode 117 is interrupted, whereby an ink end of the ink cartridge is detected. When ink is further consumed in this state, the first ink level detecting electrode 118 is exposed from ink, whereby an ink end of the ink storage chamber 92 is detected.

Figure 18B:
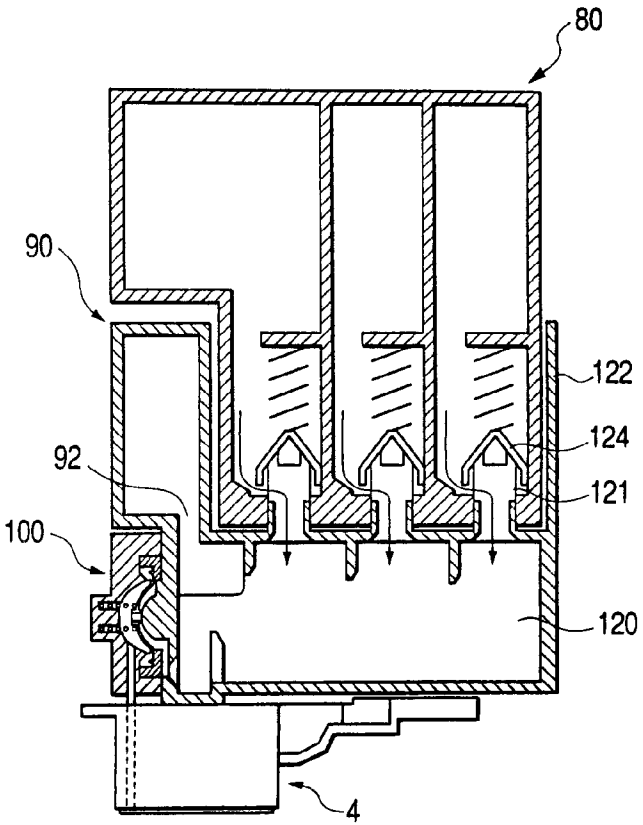
Figure 18A:
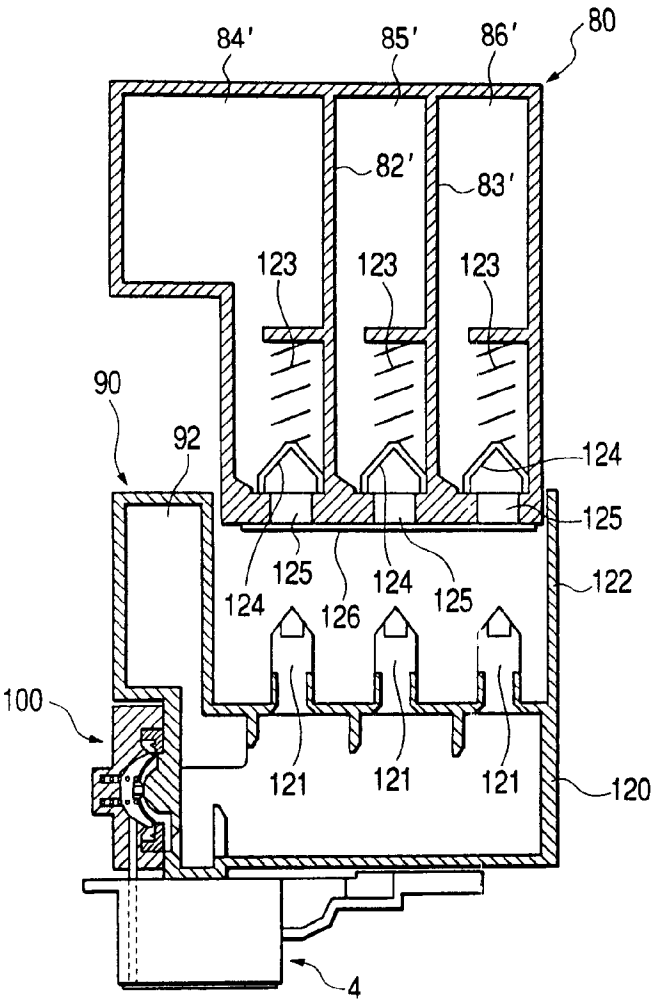

FIG. 18 show another embodiment of the present invention. In this embodiment, a communicating passage 120 is formed, which is connected to an ink storage chamber 92 and extended to a position opposite to an ink chamber of an ink cartridge 80. At least one hollow needle, hollow needles 121 corresponding in number to chambers in the ink cartridge 80 in this embodiment, is implanted to the upper surface of the communicating passage 120 to communicate with the communicating passage 120.

The ink cartridge 80 is divided into plural chambers 84', 85' and 86' by partitions 82' and 83', and formed with ink supply ports 125. Each ink supply port 125 has a valve 124 constantly biased downwardly by a spring 123, which is located opposite to the hollow needle 121 in the case where the ink cartridge 80 is mounted to a holder 122. The ink supply ports 125 are sealed by a film 126.

According to this embodiment, when the ink cartridge 80 is set in the holder 122 and pressed downward, the leading end of the hollow needle 121 pierces the film 126 and pushes up the valve 124 to open a passage. This permits ink in each chamber of the ink cartridge 80 to flow into the ink storage chamber 92 via the communicating passage 120. When the ink cartridge 80 is detached from the holder 122, the valve 124 is not supported by the hollow needle 121, and, as shown in FIG. 18 (*b*), is elastically pressed onto the ink supply port 125 by the spring 123, to thereby prevent ink from flowing from the ink supply port 125.

Figure 19B:
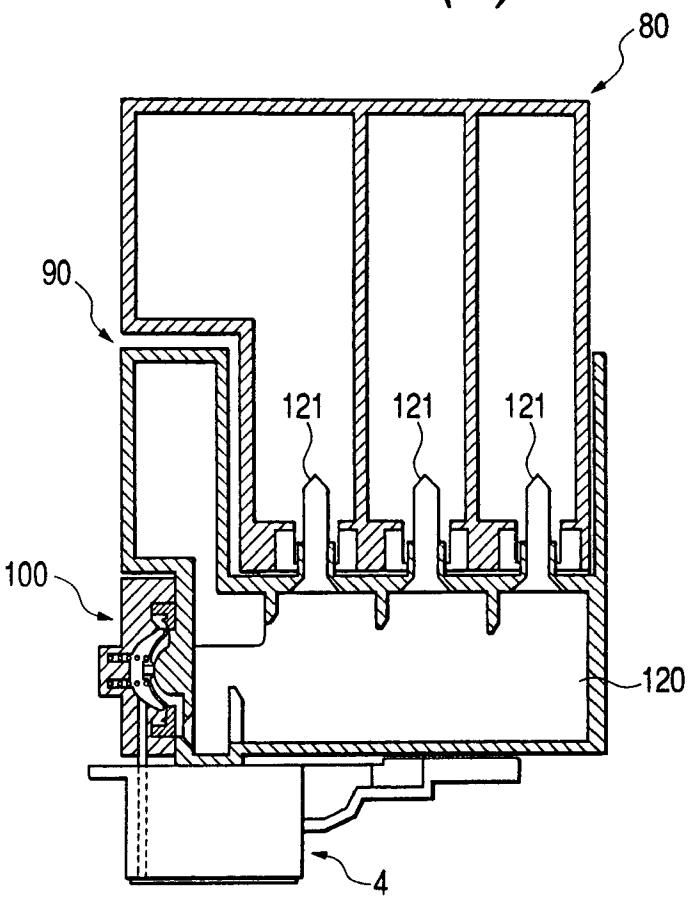
Figure 19A:
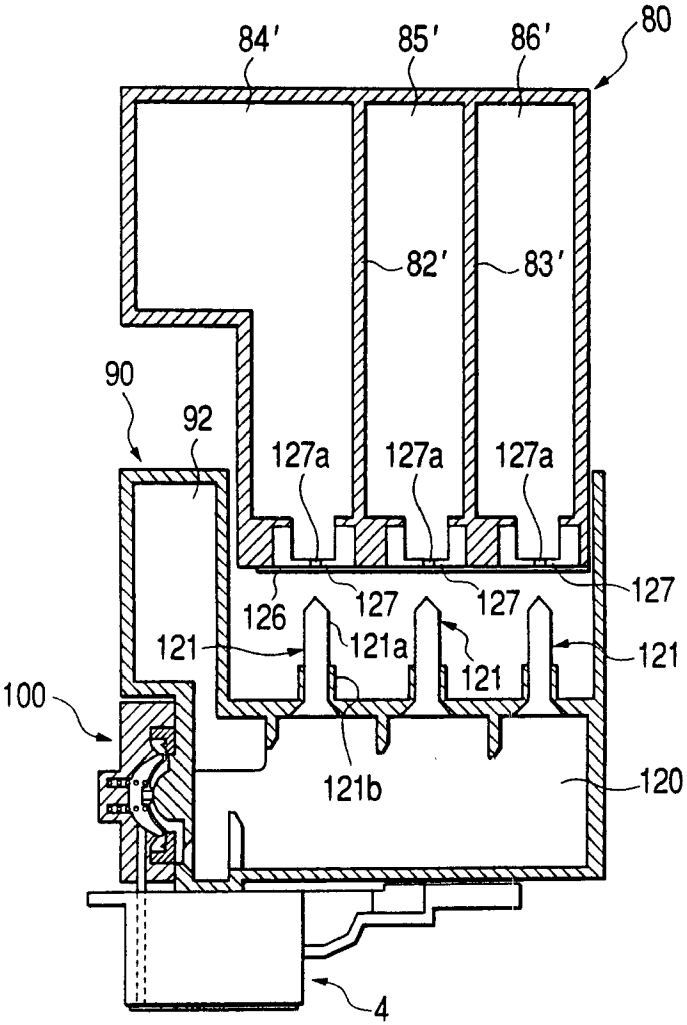

In the above embodiment, the ink supply port is sealed by the valve 124, however, as shown in FIG. 19, an elastic plate 127, such as a rubber plate, having a through hole 127*a* located at a position opposite to the leading end of the hollow needle 121 may be disposed with its opening sealed by the film 126. This also provides the similar effect.

That is, when the ink cartridge 80 is aligned with the holder 122 and pushed into the holder, the hollow needle 121 pierces the film 126 and then pushes into and widens the through-hole 127*a* of the elastic plate 127 to establish the communicate. In this state, as the periphery of the hollow needle 121 is sealed by the elastic plate 127, the leakage of ink, the evaporation of ink solvent, and further, the inflow of air are securely prevented. In this embodiment, it is preferable that the hollow needle 121 has a small-diameter part 121*a* on the leading end side, and a large-diameter part 121*b* with a tapered leading end on the area contacting the elastic plate 127.

When the ink cartridge 80 is detached from the holder 122, the hollow needle 121 is withdrawn from the elastic plate 127. Therefore, the through-hole 127*a* is contracted to hold ink with capillary force, to thereby prevent ink from flowing outside.

Figure 20:
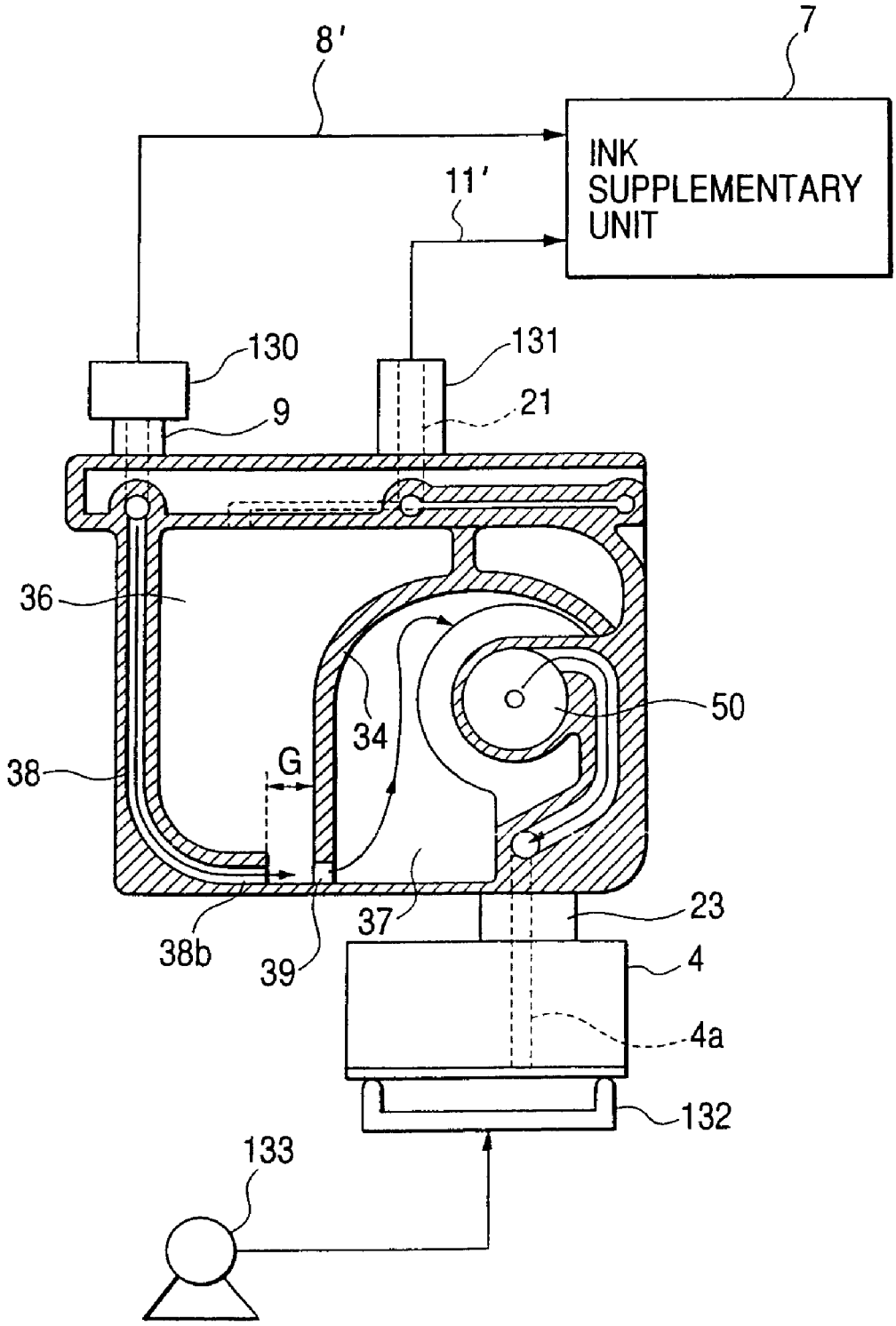
FIG. 20 explains refilling to the ink supply unit in the recording device shown in FIG. 1 and the operation for the recovery of ink ejection of the recording head.

Referring to FIG. 20, a process for supplying ink to the ink supply unit 3 via the tube 8 from the ink cartridge 5 installed in a body as shown in FIG. 1 will be described in detail below.

When the carriage 1 is moved to a position of the ink supplementing unit 7 and the ink supplementing unit is connected to the ink supply unit 3, the ink inlet 9 of the ink supply unit 3 is communicated with the ink cartridge 5 through a tube 8' extended from the ink supplementing unit 7 and the tube 8 via a coupling 130, and the air open port 21 is connected to the pump unit 10 through tubes 11' extended from the ink supplementing unit 7 and the tube 11 via a coupling 131.

When the pump unit 10 of the ink supplementing unit 7 is operated in this state, pressure in the ink storage chamber 36 is decreased, ink in the ink cartridge 5 is pulled to the ink inlet 9 via the tubes 8 and 8' and the coupling 130 and flows into the ink storage chamber 36 through the ink supply passage 38.

As the lower end 38*b* of the ink supply passage 38 is located at the bottom of the ink storage chamber 36 and a gap G exists between the lower end 38*b* and the ink inflow port 39 of the valve chest 37, air bubbles flowing along with ink rise by buoyancy in the gap G, are interrupted by the wall 34 defining the valve chamber 37 and move to the upper part of the ink storage chamber 36 without flowing into the valve chamber 37.

As described above, as negative pressure is applied to the ink storage chamber 36 and ink in the ink cartridge 5 is sucked, ink can be injected into the ink storage chamber 36 without allowing air bubbles to enter into the valve chamber 37.

After the ink storage chamber 36 is supplemented with ink of predetermined quantity, the ink inlet 9 is sealed, and further the pump unit 10 of the ink refilling unit 7 is operated to reduce the pressure of ink in the ink storage chamber 36, so that ink in the ink storage chamber can be fully degassed. Needless to say, since pressure in the ink storage chamber 36 is decreased, and the differential pressure valve mechanism 50 connected between the ink storage chamber 36 and the recording head 4 acts as a check valve, no air flows in via the recording head 4 and unnecessary high suction force does not act on the recording head.

If printing failure occurs by clogging or the like of the recording head 4 during a printing process or the like, the recording head 4 is sealed by capping means 132, and a suction pump 133 is operated, so that so-called ejection recovery processing is executed.

When negative pressure is applied by the capping means 132, the negative pressure acts on the differential pressure valve mechanism 50 from the groove 44 forming an ink passage via the ink guidepath 4*a*. Since the differential pressure valve mechanism 50 is opened when pressure on the side of the recording head 4 is decreased as described above, ink in the valve chamber 37 is filtered by the filter 56 (see FIG. 5), passes through the differential pressure regulating mechanism 50 and flows into the recording head 4.

In this ejection recovery process, if the ink cartridge 5 is connected to the ink supply unit 3 via the coupling 130 and ejection recovery processing is executed with the air open port 21 sealed, highly degassed ink rapidly reaches from the ink cartridge to the ink inflow port 39 provided in the lower part of the wall 34 defining the valve chamber 37, so that the ink flows into the valve chamber 37 without reducing the degassed rate. Even if air bubbles are caused when the ink cartridge 5 and the ink supply unit 3 are connected together, the air bubbles never enter into the valve chamber 37 as described above.

Further, if the ink inlet 9 and the air open port 21 are kept sealed, pressure in the ink storage chamber 36 is decreased, so that air dissolved in ink is released therefrom to the upper space of the ink storage chamber 36. Consequently, the degassed rate of ink can be recovered.

Industrial Availability

In the ink-jet recording device according to the present invention, ink supply means is constructed as a differential pressure valve including a coil spring and a movable membrane normally contacted elastically with a valve seat by the coil spring. Since pressure of ink supplied to an ink-jet recording head is kept negative by the coil spring, the fluctuation of the movable membrane associated with movement of a carriage can be suppressed by the coil spring. Therefore, ink can be stably supplied to the recording head while maintaining suitable negative pressure.

What is claimed is:

1. An ink supply unit adapted to be mounted on a printer, comprising:

an air communication port in fluid communication with the ambient air;

an ink supply port adapted to supply ink to the printer;

a first chamber having a bottom portion, the first chamber in fluid communication with the air communication port;

a second chamber in fluid communication with the ink supply port; and a vertical ink flow passage having a lower end connected to a bottom portion of the first chamber and an upper end connected to the second chamber;

wherein the flow passage, first chamber and second chamber are constructed, arranged and adapted in a manner such that ink in the first chamber will flow into the ink supply port via the bottom portion of the first chamber, then to the lower end of the ink flow passage, then along at least half of the length of the first chamber to the upper end of the ink flow passage and then to the second chamber, in that sequential order.

2. The ink supply unit of claim 1, further comprising a second ink flow passage having an upper end connected to the second chamber and a lower end connected to the ink supply port.

3. An ink supply unit adapted to be mounted on a printer, comprising:

an air communication port in fluid communication with the ambient air;

an ink supply port adapted to supply ink to the printer;

a first chamber having a bottom portion, the first chamber in fluid communication with the air communication port;

a second chamber in fluid communication with the ink supply port; and a vertical ink flow passage extending upwardly from the bottom of the first chamber, and having a lower end connected to the bottom portion of the first chamber and an upper end connected to the second chamber;

wherein the flow passage, first chamber and second chamber are constructed, arranged and adapted in a manner such that ink in the first chamber will flow into the ink supply port via the bottom portion of the first chamber, then to the lower end of the ink flow passage, then flow upwardly through the vertical ink flow passage to the upper end of the ink flow passage and then to the second chamber, in that sequential order.

* * * * *